US007946832B2

(12) United States Patent
Hogan

(10) Patent No.: US 7,946,832 B2
(45) Date of Patent: May 24, 2011

(54) DUAL CHAMBER MIXING PUMP

(75) Inventor: Tim Patrick Hogan, Round Lake Beach, IL (US)

(73) Assignee: Fluid Management Operations, LLC, Wheeling, IL (US)

( * ) Notice: Subject to any disclaimer, the term of this patent is extended or adjusted under 35 U.S.C. 154(b) by 957 days.

(21) Appl. No.: 11/833,040

(22) Filed: Aug. 2, 2007

(65) Prior Publication Data

US 2008/0310969 A1 Dec. 18, 2008

Related U.S. Application Data

(63) Continuation-in-part of application No. 11/359,051, filed on Feb. 22, 2006, now Pat. No. 7,648,349.

(51) Int. Cl.
*F04B 19/00* (2006.01)

(52) U.S. Cl. ..... 417/486; 417/492; 417/500

(58) Field of Classification Search ..... 417/53, 417/250, 326, 329, 403, 415, 500, 492, 486, 417/534, 535; 91/61
See application file for complete search history.

(56) References Cited

U.S. PATENT DOCUMENTS 3,447,468 A * 6/1969 Kinne ..... 417/403
4,008,003 A * 2/1977 Pinkerton ..... 417/250
5,482,448 A * 1/1996 Atwater et al. ..... 417/492
6,398,513 B1 * 6/2002 Amsler et al. ..... 417/63
6,540,486 B2 * 4/2003 Amsler et al. ..... 417/53
6,732,647 B2 * 5/2004 Uera et al. ..... 101/366
6,749,402 B2 * 6/2004 Hogan et al. ..... 417/53
2004/0013531 A1 * 1/2004 Curry et al. ..... 417/42

* cited by examiner

*Primary Examiner* — Charles G Freay
*Assistant Examiner* — Todd D Jacobs
(74) *Attorney, Agent, or Firm* — Miller, Matthias & Hull LLP

(57) ABSTRACT

A dual chamber mixing pump is disclosed with two pump chambers. The chambers are defined in part by a piston having proximal and distal ends and recessed sections disposed at both ends. The pump utilizes one common driving mechanism to axially rotate and laterally reciprocate the piston to provide continuous pumping of two fluids entering through two inlets and exiting through two outlets with reduced pulsations. Alternating pulses of the two chambers and joining of two outlets provide a common outlet stream which has small segments of alternating fluid from each inlet. Such segmented streams can become more thoroughly mixed through normal flow characteristics of the downstream flow path, providing more effective mixing.

16 Claims, 19 Drawing Sheets

DUAL CHAMBER MIXING PUMP

CROSS-REFERENCE TO RELATED APPLICATIONS

This is a continuation-in-part of U.S. patent application Ser. No. 11/359,051 filed on Feb. 22, 2006, now U.S. Pat. No. 7,648,349 still pending.

BACKGROUND

1. Technical Field

Improved nutating pumps for mixing are disclosed with a dual chamber for simultaneously pumping and optionally mixing two fluids. The two chambers are pumped 180° out of phase. Different fluids may be pumped independently in each chamber. The proportion of each fluid pumped is proportional to the annular area of the piston end which pumps that fluid. A desired proportion or ratio between multiple fluids may be achieved by varying the surface areas of the piston ends.

2. Description of the Related Art

Nutating pumps are pumps having a piston that both rotates about its axis liner and contemporaneously slides axially and reciprocally within a line or casing. The combined 360° rotation and reciprocating axial movement of the piston produces a sinusoidal dispense profile that is illustrated in FIG. 1A. In FIG. 1A, the sinusoidal profile is graphically illustrated. The line 1 graphically illustrates the flow rate at varying points during one revolution of the piston. The portion of the curve 1 above the horizontal line 2 representing a zero flow rate represents the output while the portion of the curve 1 disposed below the line 2 represents the intake or "fill." Both the pump output and pump intake flow rates reach both maximum and minimum levels and therefore there is no linear correlation between piston rotation and either pump output or pump intake.

The colorant dispensers disclosed in U.S. Pat. Nos. 6,398,513 and 6,540,486 (Amsler '513 and Amsler '486) utilize a nutating pump and a computer control system to control the pump. Prior to the system disclosed by Amsler et al., existing nutating pumps were operated by rotating the piston through a full 360° rotation and corresponding axial travel of the piston. Such piston operation results in a specific amount of fluid pumped by the nutating pump with each revolution of the piston. Accordingly, the amount of fluid pumped for any given nutating pump is limited to multiples of the specific volume. If a smaller volume of fluid is desired, then a smaller sized nutating pump is used or manual calibration adjustments are made to the pump.

For example, in the art of mixing paint, paint colorants can be dispensed in amounts as little as 1/256th of a fluid ounce. As a result, existing nutating pumps for paint colorants can be very small. With such small dispense amount capabilities, the motor of such a small pump would have had to run at excessive speeds to dispense larger volumes of colorant (multiple full revolutions) in an appropriate time period.

In contrast, larger pumps may be used to minimize the motor speed. When small dispense amounts are needed, a partial revolution dispense for such a larger capacity nutating pump would be advantageous. However, using a partial revolution to accurately dispense fluid is difficult due to the non-linear output of the nutating pump dispense profile vs. angle of rotation as shown in FIG. 1A.

To address this problem, the disclosures of Amsler '513 and '486 divide a single revolution of the pump piston into a plurality of steps that can range from several steps to four hundred steps or more. Controllers and algorithms are used with a sensor to monitor the angular position of the piston, and using this position, calculate the number of steps required to achieve the desired output. Various other improvements and methods of operation are disclosed in Amsler'513 and '486.

The sinusoidal profile illustrated in FIG. 1A is based upon a pump operating at a constant motor speed. While operating the pump at a constant motor speed has its benefits in terms of simplicity of controller design and pump operation, the use of a constant motor speed also has inherent disadvantages, some of which are addressed in U.S. Pat. No. 6,749,402 (Hogan et al.).

Specifically, in certain applications, the maximum output flow rate illustrated on the left side of FIG. 1A can be disadvantageous because the output fluid may splash or splatter as it is being pumped into the output receptacle at the higher flow rates. For example, in paint or cosmetics dispensing applications, any splashing of the colorant as it is being pumped into the output container results in an inaccurate amount of colorant being deposited in the container but also colorant being splashed on the colorant machine which requires labor intensive clean-up and maintenance. Obviously, this splashing problem will adversely affect any nutating pump application where precise amounts of output fluid are being delivered to an output receptacle that is either full or partially full of liquid or small output receiving receptacles.

For example, the operation of a conventional nutating pump having the profile of FIG. 1A results in pulsed output flow as shown in FIGS. 1B and 1C. The pulsed flow shown at the left in FIGS. 1B and 1C, at speeds of 800 and 600 rpm respectively, results in pulsations 3 and 4 which are a cause of unwanted splashing. FIGS. 1B and 1C are renderings of actual digital photographs of an actual nutating pump in operation. While reducing the motor speed from 800 to 600 rpm results in a smaller pulse 4, the reduction in pulse size is minimal and the benefits are offset by the slower operation. To avoid splashing altogether, the motor speed would have to be reduced substantially more than 20% thereby making the choice of a nutating pump less attractive despite its high accuracy. A further disadvantage to the pulsed flow shown in FIG. 1A is an accompanying pressure spike that cause an increase in motor torque.

In addition to the splashing problem of FIG. 1A, the large pressure drop that occurs within the pump as the piston rotates from the point where the dispense rate is at a maximum to the point where the intake rate is at a maximum (i.e. the peak of the curve shown at the left of FIG. 1A to the valley of the curve shown towards the right of FIG. 1A) can result in motor stalling for those systems where the motor is operated at a constant speed. As a result, motor stalling will result in an inconsistent or non-constant motor speed, there by affecting the sinusoidal dispense rate profile illustrated in FIG. 1A, and consequently, would affect any control system or control method based upon a preprogrammed sinusoidal dispense profile. The stalling problem will occur on the intake side of FIG. 1A as well as the pump goes from the maximum intake flow rate to the maximum dispense flow rate.

The splashing and stalling problems addressed by Hogan et al. are illustrated partly in FIG. 2 which shows a modified dispense profile 1*a* where the motor speed is varied during the pump cycle to flatten the curve 1 of FIG. 1A. The variance in motor speed results in a reduction of the peak output flow rate while maintaining a suitable average flow rate by (i) increasing the flow rates at the beginning and the end of the dispense portion of the cycle, (ii) reducing the peak dispense flow rate, (iii) increasing the duration of the dispense portion of the cycle and (iv) reducing the duration of the intake or fill portion of the cycle. This is accomplished using a computer algorithm that controls the speed of the motor during the cycle thereby increasing or decreasing the motor speed as necessary to achieve a dispense curve like that shown in FIG. 2.

However, the nutating pump design of Hogan et al. as shown in FIG. 2, while reducing splashing, still results in a start/stop dispense profile and therefore the dispense is not a pulsation-free or completely smooth flow. Despite the decrease in peak dispense rate, the abrupt increase in dispense rate shown at the left of FIG. 2 and the abrupt drop off in flow rate shown at the center of FIG. 2 still provides for the possibility of some splashing. Further, the abrupt starting and stopping of dispensing followed by a significant lag time during the fill portion of the cycle still presents the problems of significant pressure spikes and bulges and gaps in the fluid stream exiting the dispense nozzle. Any decrease in the slope of the portions of the curves shown at 1*a*, 1*c* would require in increase in the cycle time as would any decrease in the maximum fill rate. Thus, the only modifications that can be made to the cycle shown in FIG. 2 to reduce the abruptness of the start and finish of the dispensing portion of the cycle would result in increasing the cycle time and any reduction in the maximum fill rate to reduce pressure spiking and motor stalling problems would also result in an increase in the cycle time.

Accordingly, there is a need for an improved nutating pump, also adapted for mixing and having two pump chambers, with improved control and/or a method of control thereof whereby the pump motor is controlled so as to reduce the likelihood of splashing and "pulsing" during dispense without compromising pump speed and accuracy.

SUMMARY OF THE DISCLOSURE

Creation of fluid mixtures for food, petrochemical, or other industries requires some means of mixing multiple fluids together in particular proportions. Whether done in batch, or in a continuous process, there may be requirements for accuracy of proportions, quality of mixing, and ability to start and stop the process at will, to provide only the amount of mixture, as it is needed. Furthermore, there may be other applications, where two flows must be in direct proportion, to be used separately, mixed at a later time, or mixed further in the flow path.

In satisfaction of the aforenoted needs, a dual chamber mixing pump is disclosed which includes two pump chambers within the nutating pump for mixing two fluids at a main output. The output from the additional pump chamber of the disclosed embodiments occurs during a different part of the piston cycle than that of the first pump chamber thereby distributing the mixed output over the entire piston or pump cycle as opposed to half or part of the cycle.

In one aspect, the dual chamber mixing pump comprises a rotating and reciprocating piston disposed in a pump housing. The housing comprises a proximal inlet, a distal inlet, a proximal outlet and a distal outlet. The housing further comprises a proximal seal and a middle seal. The piston comprises a proximal section and a distal end with a pump section disposed between the proximal section and the distal end. The proximal section is linked to a motor and is connected to a pump section at a proximal end. The proximal section has a first maximum outer diameter while the pump section has a second maximum outer diameter that is greater than the first maximum outer diameter. The pump section further comprises a proximal recessed section at the proximal end and a distal recessed section at the distal end. The pump section extends between the proximal and distal recessed sections and is at least partially and frictionally received in the middle seal of the housing.

In a related refinement, two pump chambers are defined by the housing and piston. A proximal chamber is defined by the proximal recessed section and the proximal end of the pump section and the housing. A distal chamber is defined by the distal recessed section and the distal end of the pump section and the housing. The two chambers are axially isolated from each other by the middle seal and the pump section of the piston.

In another refinement, the proximal and distal recessed sections are in alignment with each other. In a related refinement, the proximal inlet and the distal outlet are disposed in alignment. In yet another related refinement, the proximal outlet and the distal inlet are disposed in alignment.

In another refinement, the proximal and distal recessed sections are disposed diametrically opposite the pump section of the piston from each other.

In another refinement, the pump comprises a controller operatively connected to the motor. The controller generates a plurality of output signals including at least one signal to vary the speed of the motor.

In another refinement, the diameter of the proximal section is varied to adjust the annular area of the proximal end. The varied annular area thus varies the proportional output of the proximal chamber.

In another refinement, a passageway connects between the proximal and distal outlets leading to a mixing chamber for mixing two fluids.

In another aspect, a disclosed dual chamber mixing pump comprises a rotating and reciprocating piston disposed in a pump housing. The pump housing comprises a proximal inlet, a distal inlet, a proximal outlet and a distal outlet. Each inlet and outlet pair is in fluid communication with an interior of the housing. The housing further comprises a proximal seal and a middle seal. The piston comprises a proximal section and a distal end with a pump section disposed between the proximal section and the distal end. The proximal section is connected to the pump section at a proximal end. The proximal section is linked to a motor and has a first maximum outer diameter. The pump section has a second maximum outer diameter that is greater than the first maximum outer diameter. The pump section also comprises a proximal recessed section at the proximal end and a distal recessed section at the distal end. The pump section extends between the proximal and distal recessed sections.

In a related refinement, at least a portion of the pump section disposed between the proximal recessed section and the distal recessed section is at least partially and frictionally received in the middle seal. Further, at least a portion of the pump section that comprises the proximal recessed section is frictionally received in the proximal seal. The proximal section of the piston passes through the proximal seal. The housing and piston define two pump chambers. A proximal chamber is defined by the proximal recessed section and the proximal end of the pump section, the proximal seal and the housing. A distal chamber is defined by the distal recessed section and the distal end of the pump section and the housing. The proximal and distal chambers are axially isolated from each other by the middle seal and the portion of the pump section of the piston disposed between the proximal and distal recessed sections.

In another refinement, a passageway connects between the proximal and distal outlets leading to a mixing chamber for mixing two fluids.

In another refinement, the proximal and distal recessed sections are in alignment with each other.

In another refinement, the proximal and distal recessed sections are disposed diametrically opposite the pump section of the piston from each other.

In another refinement, the pump also comprises a controller operatively connected to the motor. The controller generates a plurality of output signals including at least one signal to vary the speed of the motor.

In another refinement, the diameters of the proximal and distal sections are varied to adjust annular areas of the proximal and distal ends. The varied annular areas, in turn vary the proportional output of each respective chamber.

In another aspect, a method of mixing fluids is provided which comprises providing a dual chamber mixing pump as recited above, pumping a first fluid from the proximal chamber to the proximal outlet and loading a second fluid into the distal chamber by rotating and axially moving the piston so the proximal end of the pump section moves toward and into the proximal chamber and the distal end exits the distal chamber, and pumping a second fluid from the distal chamber to the distal outlet and loading a first fluid into the proximal chamber by rotating and axially moving the piston so the distal end of the pump section moves toward and into the distal chamber and the proximal end exits the proximal chamber.

In a refinement, a plurality of dual chamber mixing pumps are used out of phase from each other.

Other advantages and features will be apparent from the following detailed description when read in conjunction with the attached drawings.

BRIEF DESCRIPTION OF THE DRAWINGS

The disclosed embodiments are illustrated more or less diagrammatically in the accompanying drawings, wherein.

It will be noted that the drawings are not necessarily to scale and that the disclosed embodiments are sometimes illustrated by graphic symbols, phantom lines, diagrammatic representations and fragmentary views. In certain instances, details may have been omitted which are not necessary for an understanding of the disclosed embodiments or which render other details difficult to perceive. It should be understood, of course, that this disclosure is not limited to the particular embodiments illustrated herein.

DETAILED DESCRIPTION OF THE PRESENTLY PREFERRED EMBODIMENTS

Figure 1A:
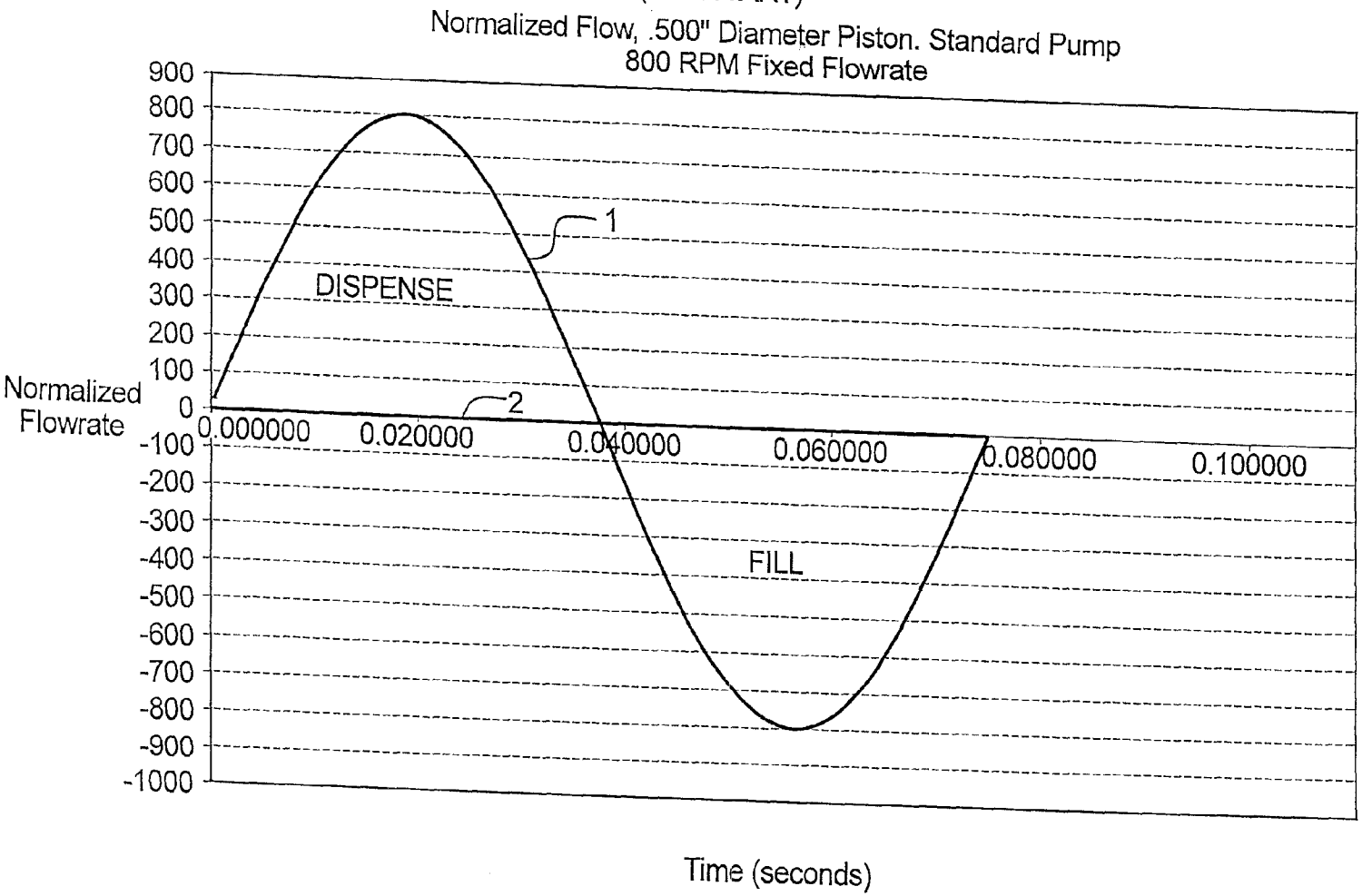
FIG. 1A (PRIOR ART)
FIG. 1A illustrates, graphically, a prior art dispense/fill profile for a prior art nutating pump operated at a fixed motor speed.
Figure 1B:
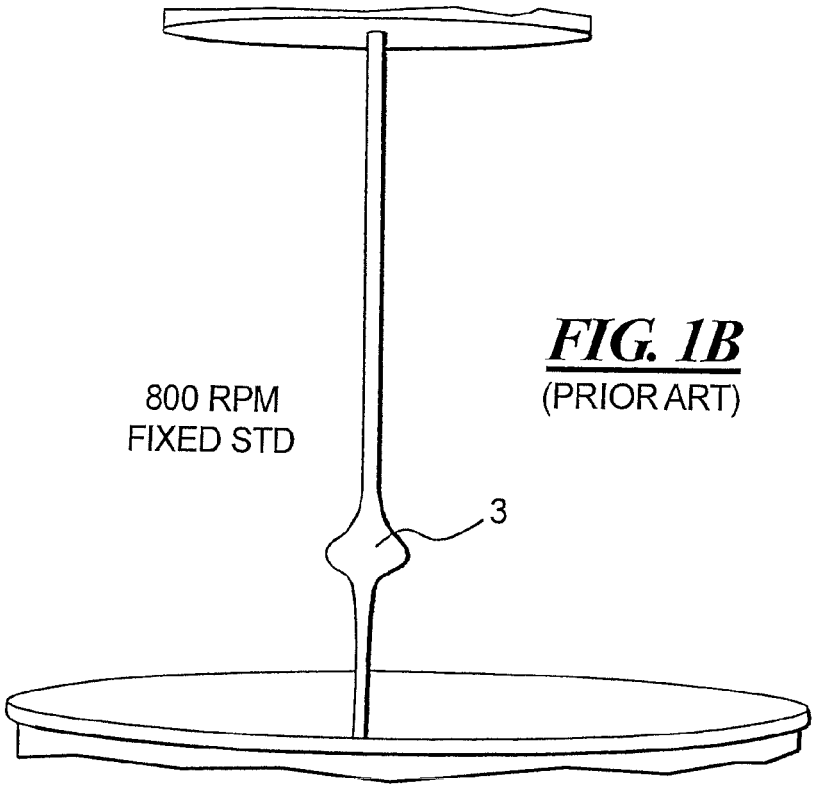
FIG. 1B (PRIOR ART)
FIG. 1B is a rendering from a photograph illustrating the pulsating dispense stream of the pump, the operation of which is graphically depicted in FIG. 1A.
Figure 1C:
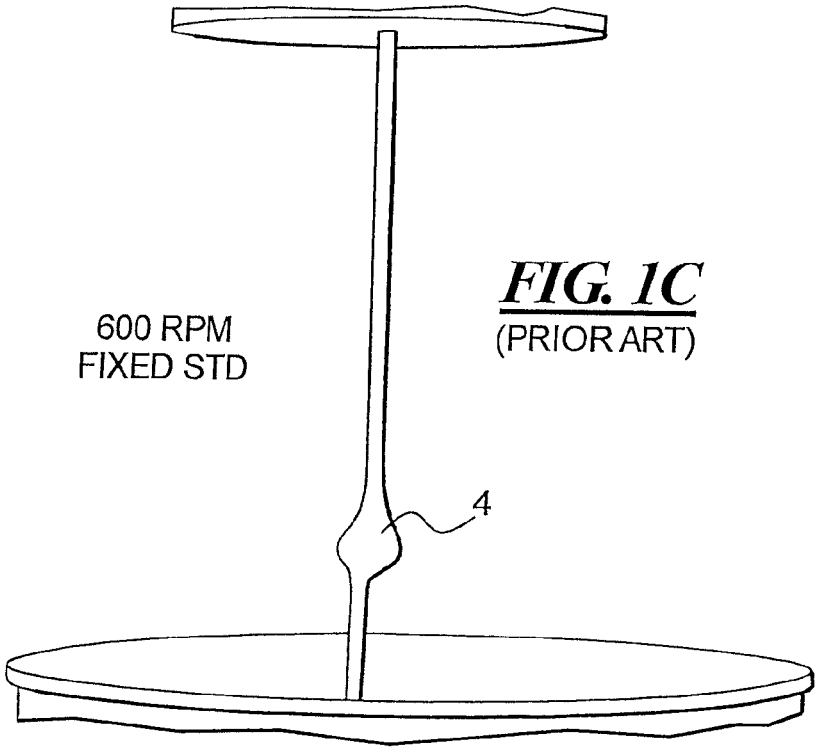
FIG. 1C (PRIOR ART)
FIG. 1C is another rendering of a photograph of an output stream of a prior art pump operated at a constant, but slower motor speed.
Figure 1D:
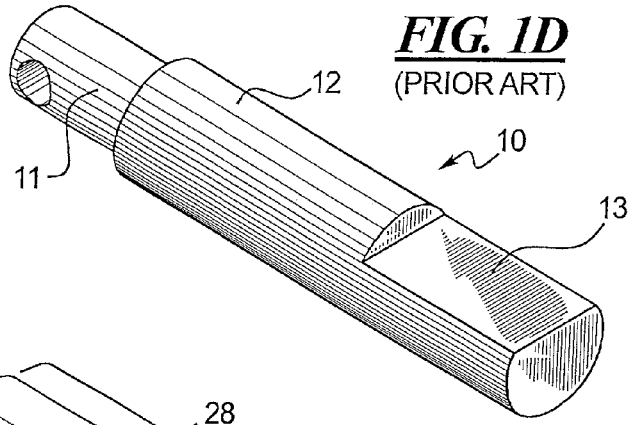
FIG. 1D (PRIOR ART)
FIG. 1D is a perspective view of a prior art nutating pump piston.

Turning first to FIG. 1D, a prior art piston 10 is shown with a narrower portion 11 that is linked or coupled to the motor. The wider section 12 is the only section disposed within the pump chamber. The wider section 11 includes a flattened portion 13 which is the active pumping area. The differences between the prior art piston 10 of FIG. 1D and the pistons of this disclosure will be explained in greater detail below.

Figure 6A:
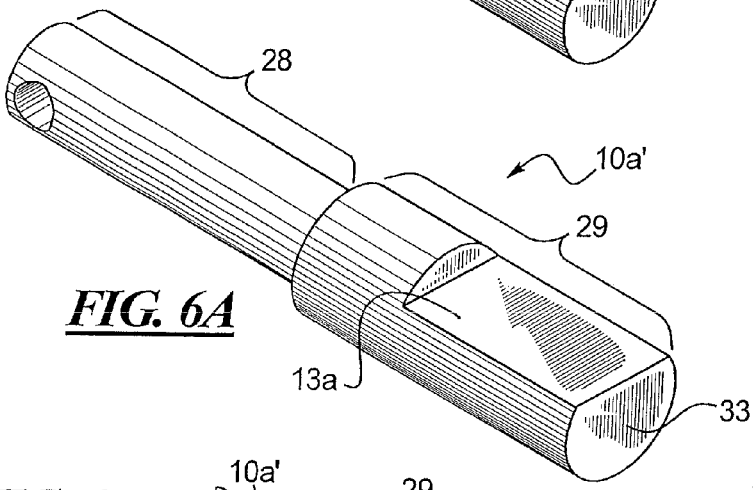
FIGS. 6A-6D are perspective, side, plan and end views of a nutating pump piston made in accordance with this disclosure.

Turning to FIGS. 3A-3D, a nutating pump 20 is shown. The pump 20 includes a rotating and reciprocating piston 10A that is disposed within a pump housing 21. The pump housing 21, in the embodiment illustrated in FIGS. 3A-3B also includes an end cap or head 22. The housing or casing 21 may also be connected to an intermediate housing 23 used primarily to house the coupling 24 that connects the piston 10*a* to the drive shaft 25 which, in turn, is coupled to the motor shown schematically at 26. The coupling 24 is connected to the proximal end 26 of the piston 10*a* by a link 27. A proximal section 28 of the piston 10*a* has a first maximum outer diameter that is substantially less than the second maximum outer diameter of the larger pump section 29 of the piston 10*a*. For a clear understanding of what is meant by "proximal section" and "pump section" 29, see also FIGS. 6A-6C. The purpose of the larger maximum outer diameter of the pump section 29 will be explained in greater detail below. The proximal section 28 is connected to the pump section 29 by a beveled transition section 31. Comparing 3A-3D, it will be noted that the piston 10*a'* shown in FIGS. 6A-6D includes a vertical transition section 31' while the transition section 31 shown in FIGS. 3A-3D is slanted or beveled. Either possibility is acceptable as the orientation shown in FIG. 6 does not affect displacement from the second chamber; the difference in cross sectional areas of the proximal section 28 and the pump section 29 determines displacement.

Returning to FIGS. 3A-3D, the pump section 29 of the piston 10*a* passes through a middle seal 32. The distal end 33 of the pump section 29 of the piston 10*a* is also received in a distal seal 34. A fluid inlet is shown at 35 and a fluid outlet is shown at 36. The proximal section 28 of the piston passes through a proximal seal 38 disposed within the seal housing 39.

Figure 6B:
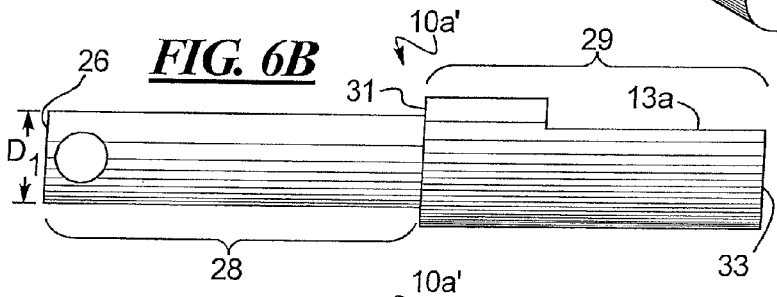
Figure 6D:
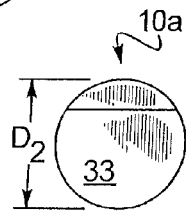
Figure 6C:
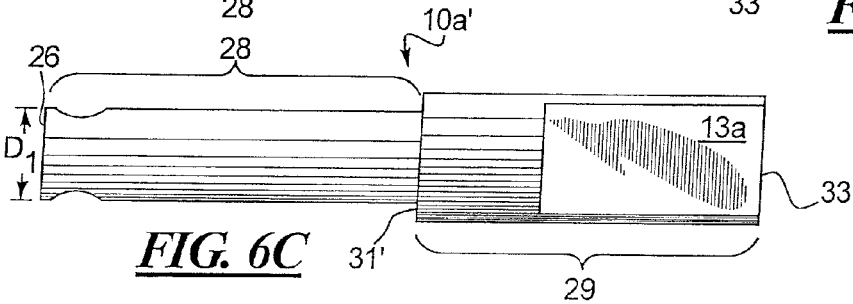

Turning to FIGS. 6B-6D, the first maximum outer diameter $D_1$ of the proximal section 28 and the second maximum outer diameter $D_2$ of the pump section 29 are illustrated. It is the differences in these diameters $D_1$ and $D_2$ that generate displacement in the second chamber. The first pump chamber is shown at 42 in FIGS. 3A, 3B and 3D. The first chamber 42 is covered by the piston 10*a* in FIG. 3C. Generally speaking, the first chamber 42 is not a chamber per se but is an area where fluid is primarily displaced by the axial movement of the piston 10*a* from the position shown in FIG. 3A to the right to the position shown in FIG. 3C as well as the rotation of the piston and the engagement of fluid disposed in the first chamber or area 42 by the machined flat area shown at 13*a* in FIGS. 3B-3D. The machined flat area 13*a* is hidden from view in FIG. 3A. A conduit or passageway shown generally at 43 connects the first chamber 42 to the second chamber or area 44.

Figure 3A:
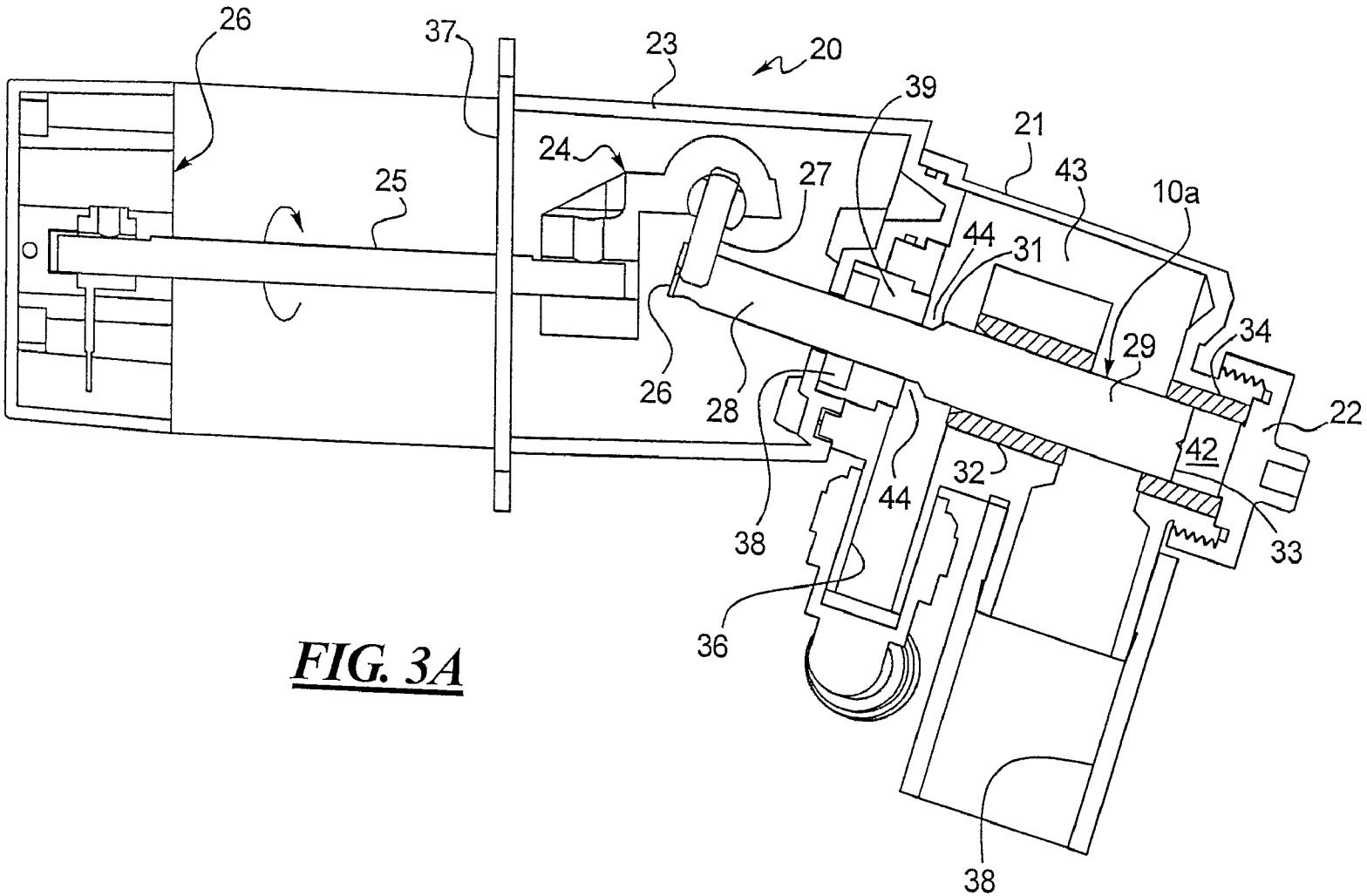
FIG. 3A is a sectional view of a disclosed nutating pump showing the piston at the "bottom" of its stroke with the stepped transition between the smaller proximal section of the piston and the larger pumping section of the piston disposed within the "second" chamber and with the distal end of the piston being spaced apart from the housing or end cap thereby clearly illustrating the "first" pump chamber.

Still referring to FIG. 3A, the piston 10*a* is shown at the "bottom" of its stroke. The transition or step 31 is disposed well within the second chamber 44 and the distal end 33 of the pump section 29 of the piston 10*a* is spaced apart from the head 22. Fluid is disposed within the first chamber 42. The first chamber 42 is considered to be bound by the flat or machined portion 13*a* of the piston 10*a*, the distal end 33 of the pump section 29 of the piston 10*a* and the surrounding housing elements which, in this case, are the distal seal 34 and head 22. It is the pocket shown at 42 in FIG. 3 where fluid is collected between the piston 10*a* and the surrounding structural elements and pushed out of the area 42 by the movement of the piston towards the head 22 or in the direction of the arrow 45 shown in FIG. 3B.

Figure 3B:
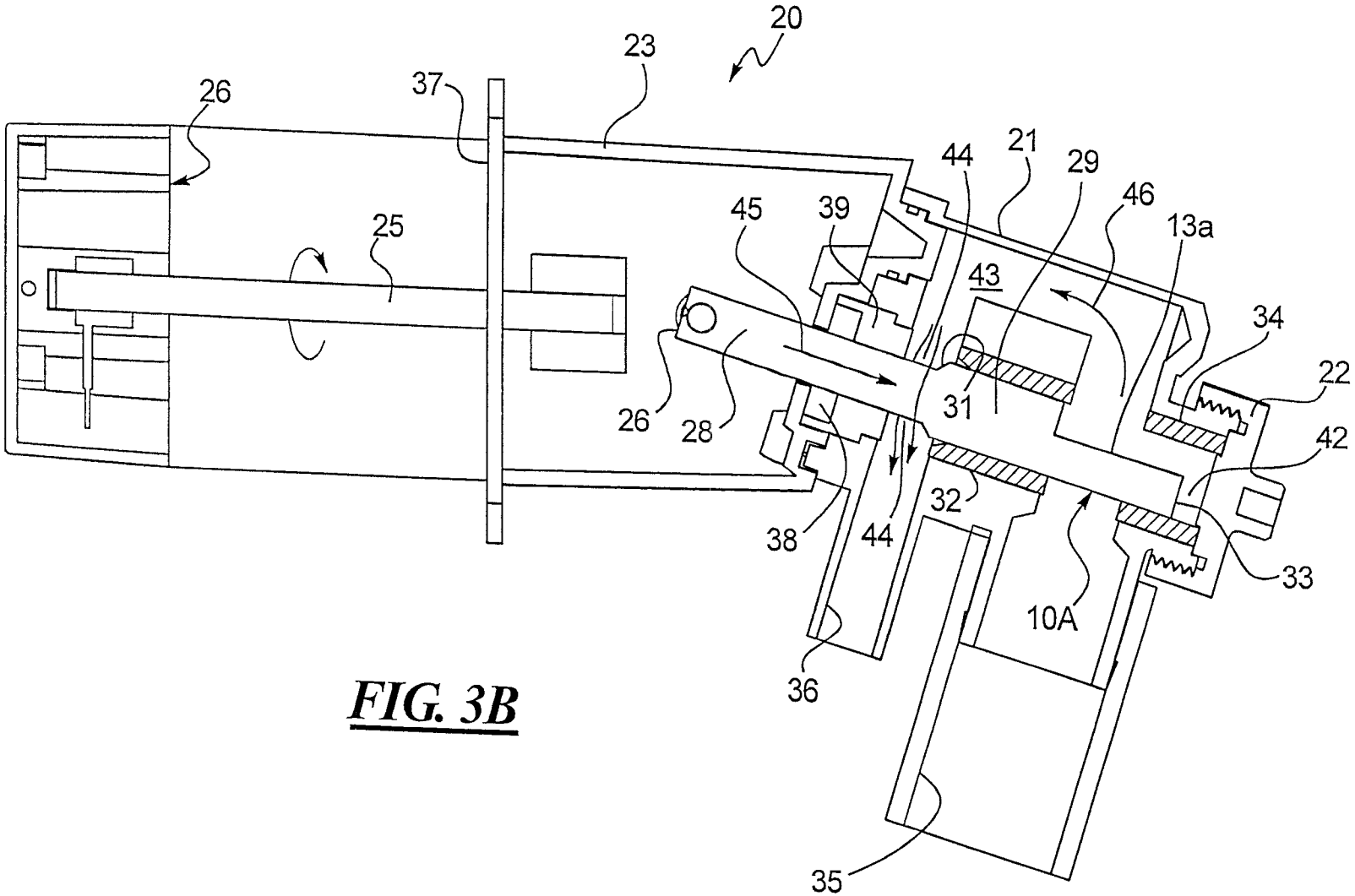
FIG. 3B is another sectional view of the pump shown in FIG. 3A but with the piston having been rotated and moved forward to the middle of its upstroke and clearly illustrating fluid leaving the first chamber and passing through the second chamber.

While the piston 10*a* is at the bottom of its stroke in FIG. 3A, the piston 10*a* has moved to the middle of its stroke in FIG. 3B as the end 33 of the pump section 29 of the piston 10*a* approaches the head 22 or housing structural element (see the arrow 45). As shown in FIG. 3B, fluid is being pushed out of the first pump area or chamber 42 and into the passageway 43 (see the arrow 46). This action displaces fluid disposed in the passageway 43 and causes it to flow around the proximal section 28 and transition section 31 of the piston 10*a*, or through the second chamber 44 as shown in FIG. 3B. It will also be noted that the flat or machined area 13*a* of the piston 10*a* has been rotated thereby also causing fluid flow in the direction of the arrow 46 through the passageway 43 and towards the second chamber or area 44.

Figure 3C:
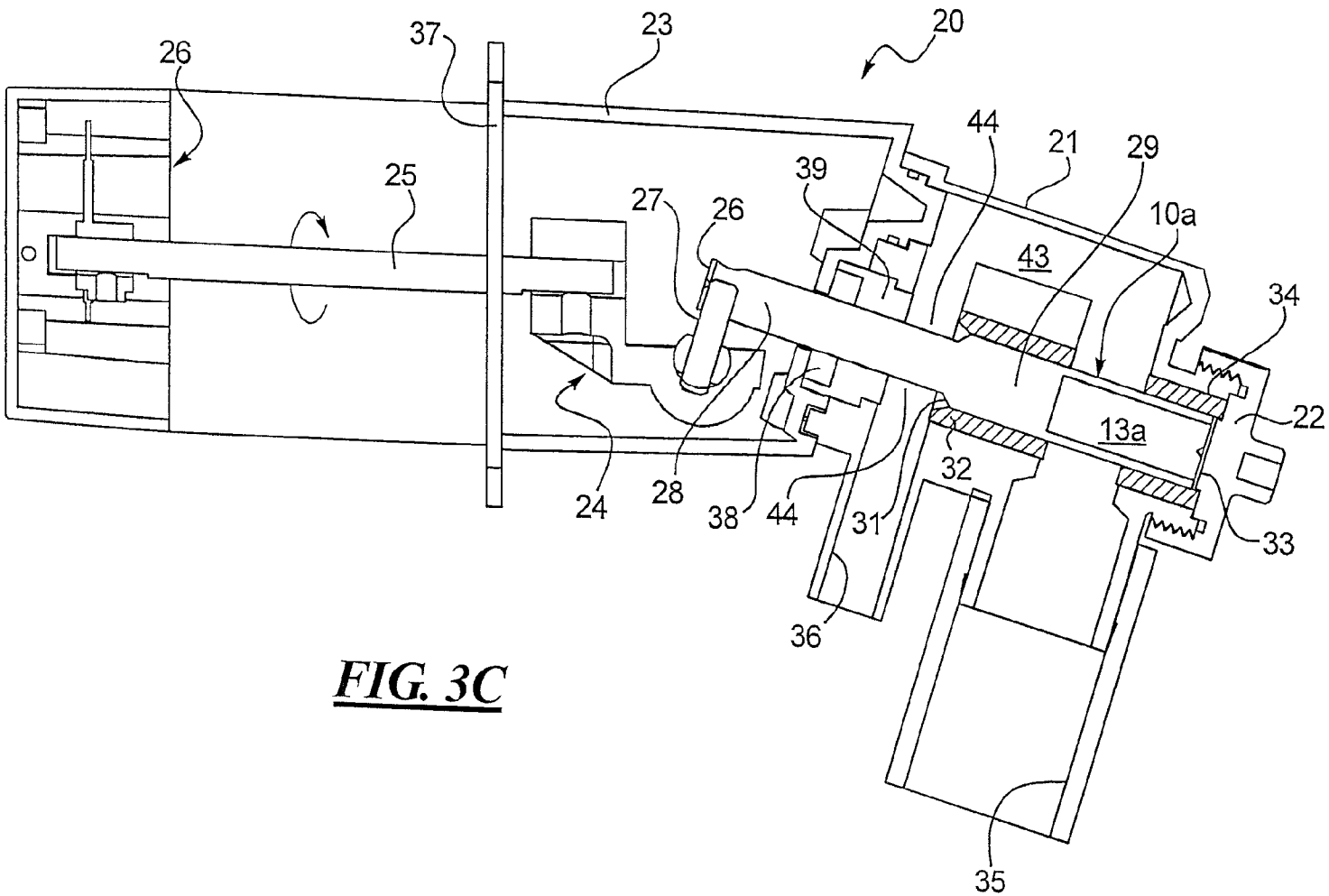
FIG. 3C is another sectional view of the pump illustrated in FIGS. 3A and 3B but with the piston rotated and moved towards the head or end cap at the top of the piston stroke with the narrow proximal portion of the piston (i.e., the narrow portion connected to the coupling) disposed in the second chamber and with the wider pump section of the piston disposed in the middle seal that separates the second from the first pump chambers.
Figure 3D:
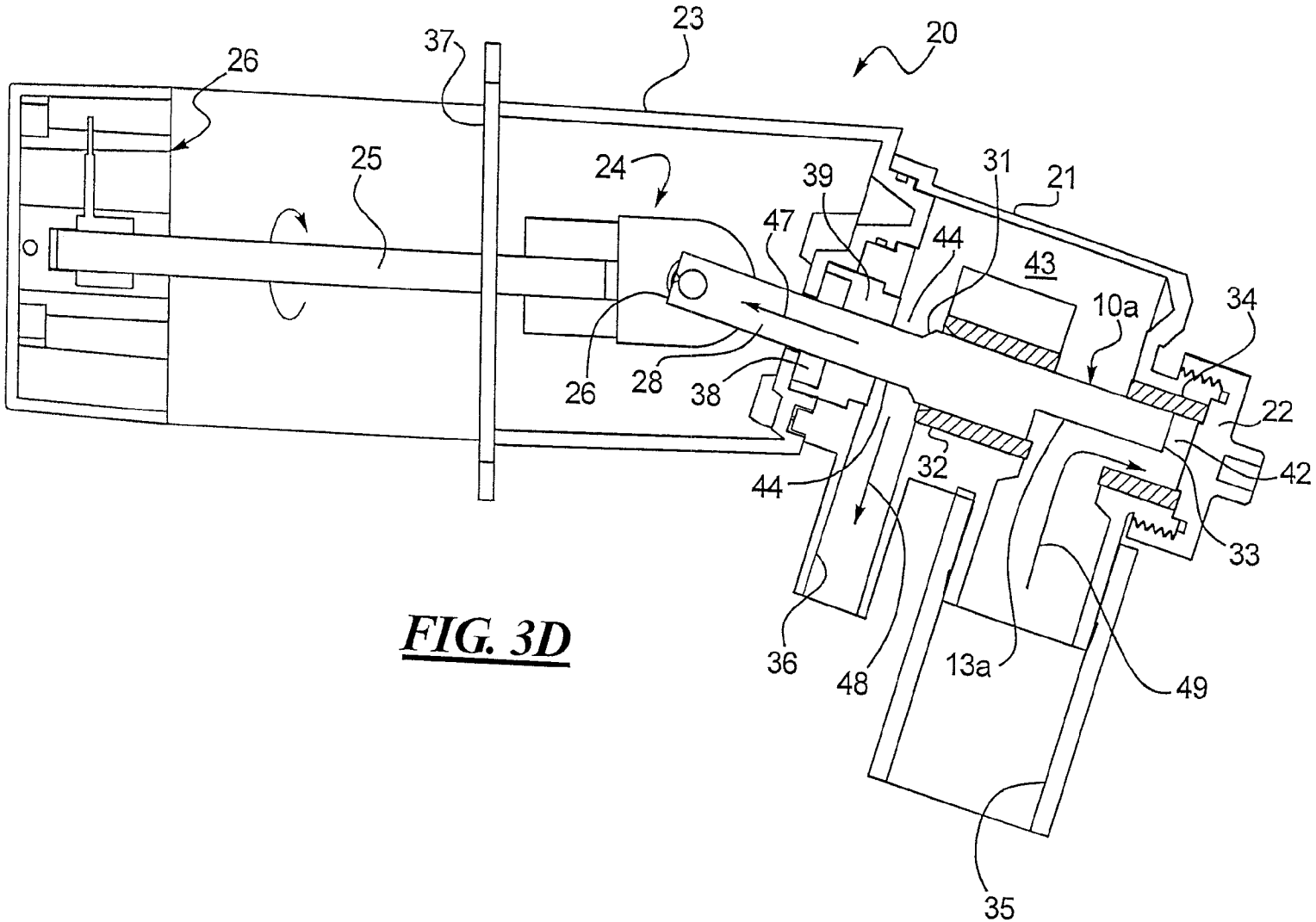
FIG. 3D is another sectional view of the pump illustrated in FIGS. 3A-3C but with the piston rotated again and moved away from the housing end cap as the piston is moved to the middle of its downstroke, and illustrating fluid entering the first chamber and exiting the second chamber.

As FIG. 3B shows the piston 10*a* in the middle of its upstroke, FIG. 3C shows the piston 10*a* at the top or end of its stroke. The distal end 33 of the pump section 29 of the piston 10*a* is now closely spaced from the head or end cap 22. Fluid has been flushed out of the first chamber or area 42 (not shown in FIG. 3C) and into the passageway 43 and second chamber or area 44 before passing out through the outlet 36. Now, a reciprocating movement back towards the position shown in FIG. 3A is commenced and illustrated in FIG. 3D. As shown in FIG. 3D, the piston 10*a* is moved in the direction of the arrow 47 which causes the transition section 31 to enter the second chamber or area 44 thereby causing fluid to be displaced through the outlet or in the direction of the arrow 48. No fluid is being pumped from the first chamber or area 42 at this point but, instead, the first chamber or area 42 is being loaded by fluid entering through the inlet and flowing into the chamber or area 42 in the direction of the arrow shown at 49.

In short, what is illustrated in FIG. 3D is the dispensing of a portion of the fluid dispensed from the first chamber or area 42 during the motion illustrated by the sequence of FIGS. 3A-3C. Instead of all of this fluid being dispensed at once and there being a lull or no dispense volume during the fill portion of the cycle illustrated in FIG. 3D, a portion of the fluid pumped from the first chamber or area 42 is pumped from the second chamber or area 44 during the fill portion of the cycle illustrated in FIG. 3D. In other words, a portion of the fluid being pumped is "saved" in the second chamber or area 44 and it is dispensed during the fill portion of the cycle as opposed to all of the fluid being dispensed during the dispense portion of the cycle. As a result, the flow is moderated and pulsing is avoided. Further, production is not compromised or reduced, but merely spread out over the entire cycle.

Figure 4A:
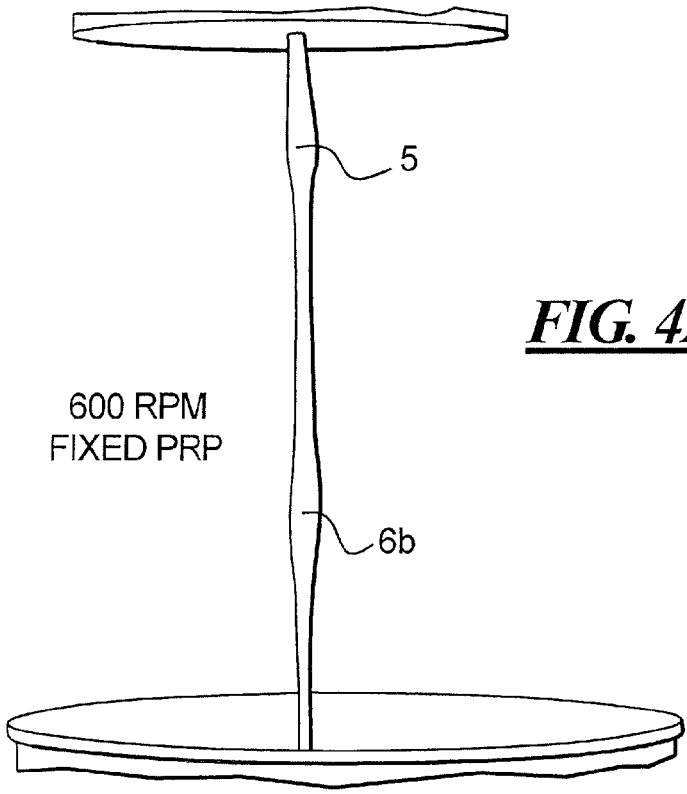
FIG. 4A is a rendering of an actual photograph of a dispense stream from the nutating pump illustrated in FIGS. 3A-3D operating at a fixed motor speed of 600 rpm.
Figure 4B:
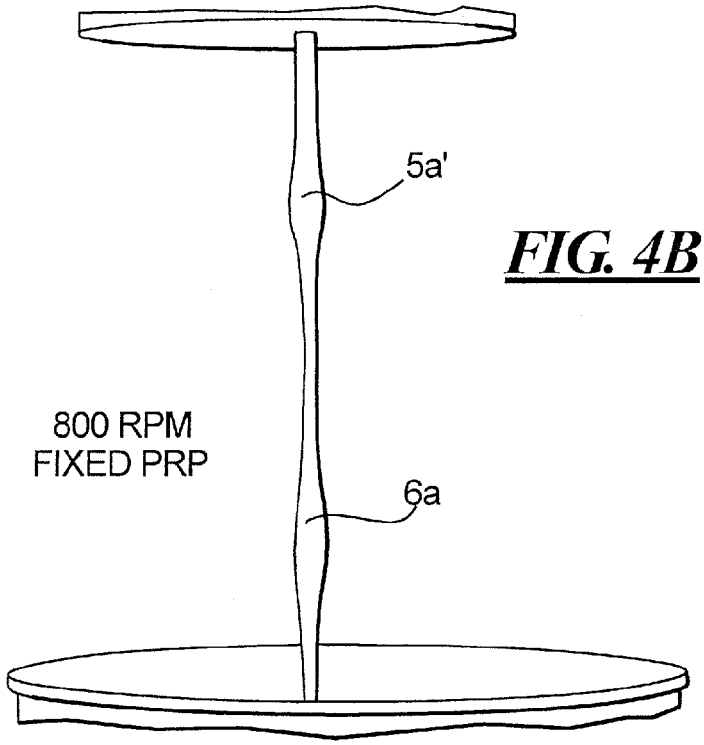
FIG. 4B is another rendering of a digital photograph of an output stream from the pump illustrated in FIGS. 3A-3D but operating at a fixed motor speed of 800 rpm and also using a fixed pulse-reduced dispense scheme.

Turning to FIGS. 4A-4B, renderings of actual dispense flows from a pump may in accordance with FIGS. 3A-3D are illustrated. In FIG. 4A, the pump is operated at a fixed motor speed of 600 rpm. As shown in FIG. 4A, only minor increases in flow shown at 5 and 6 can be seen and no serious pulsations like those shown at 3 and 4 in FIGS. 1B and 1C are evident. Increasing the motor speed to a fixed 800 rpm results in substantially no increase in the pulsations shown at 5*a* and 6*a* in FIG. 4B. Thus, with a pump constructed in accordance with FIGS. 3A-3D, the average speed can be increased from 600 rpm to 800 rpm with little or no increase in pulsation size. Further, the speed can be increased even more while maintaining little or no increase in pulsation size if an additional pulse reduction control scheme is implemented that will be discussed below in connection with FIG. 5C.

Figure 5A:
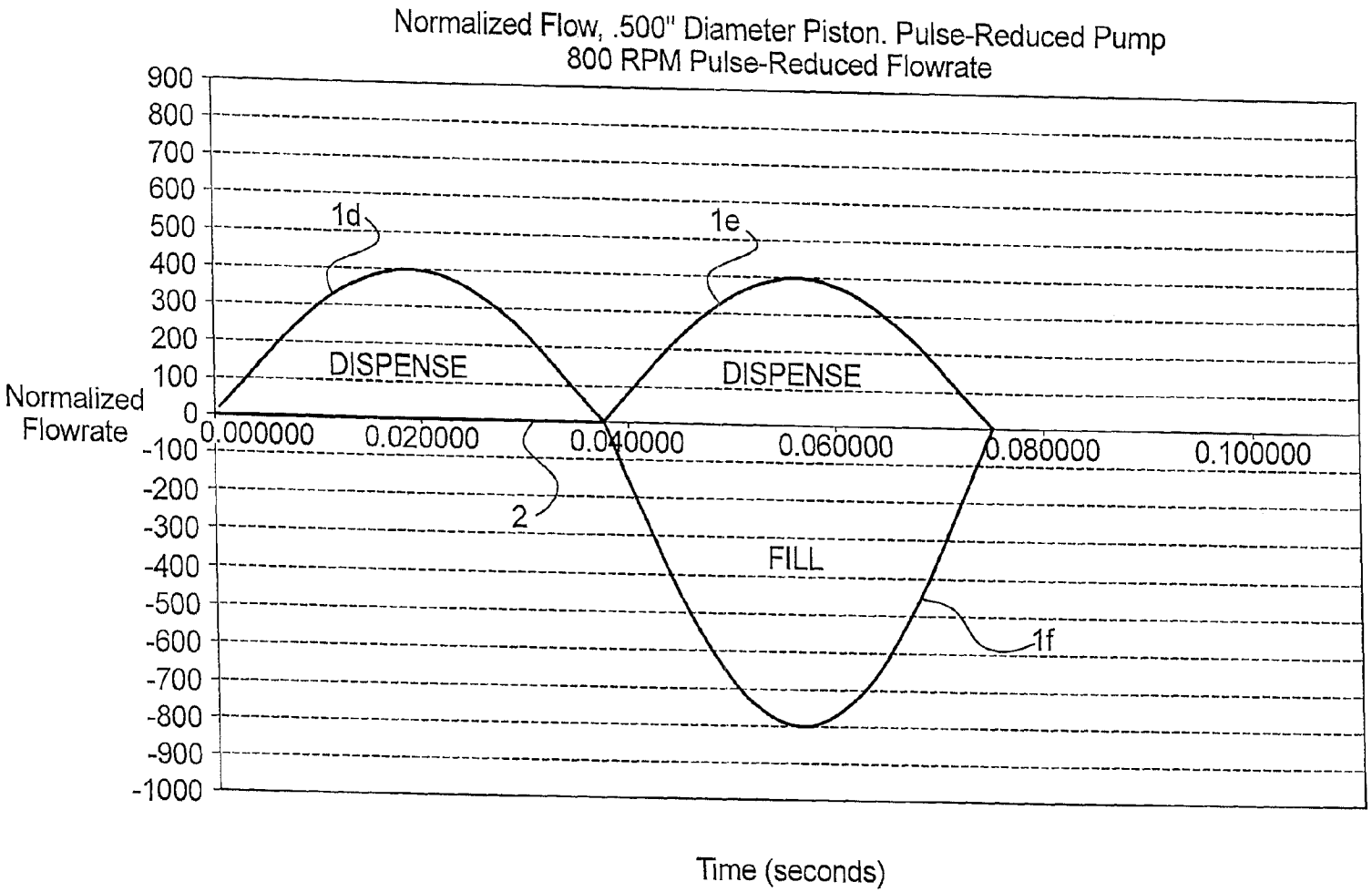
FIG. 5A graphically illustrates a dispense profile for a disclosed pump operating at a fixed motor speed of 800 rpm like that shown in FIG. 4B.

Turning to FIG. 5A, a dispense profile is shown for a pump constructed in accordance with FIGS. 3A-3D and operating at a constant motor speed of 800 rpm. Two dispense portions are shown at 1*d* and 1*e* and a fill portion of the profile is shown at 1*f*. Only a slight break in dispensing occurs at the beginning of the fill portion of the cycle and moderated dispense flows are shown by the curves 1*d*, 1*e*. FIG. 5A is a graphical representation of the flow illustrated by FIG. 4B which, again, is a rendering of a digital photograph of an actual pump in operation.

Figure 2:
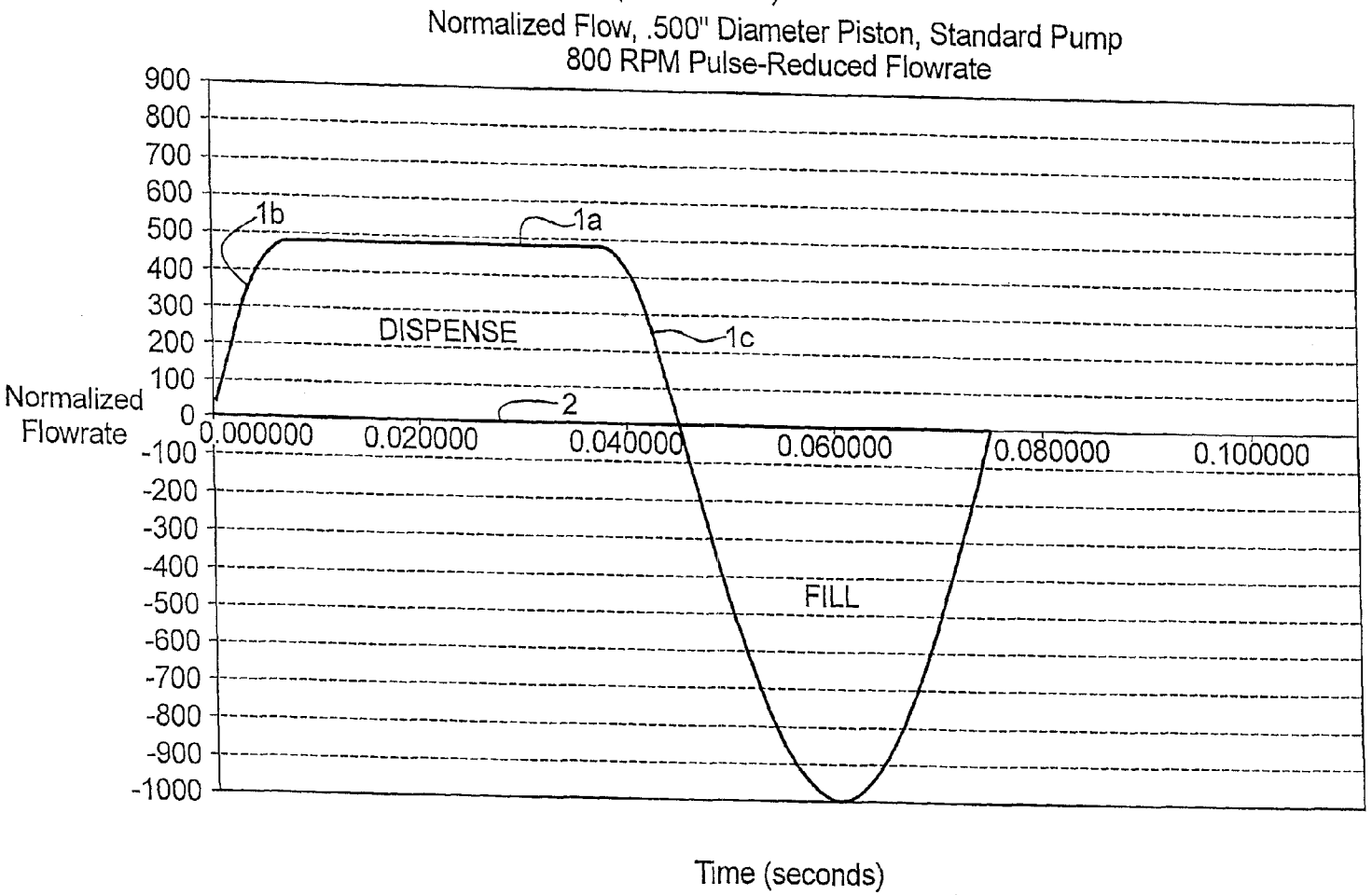
FIG. 2 (PRIOR ART)
FIG. 2 graphically illustrates a dispense and fill cycle for a prior art nutating pump operated at variable speeds to reduce pulsing.
Figure 5B:
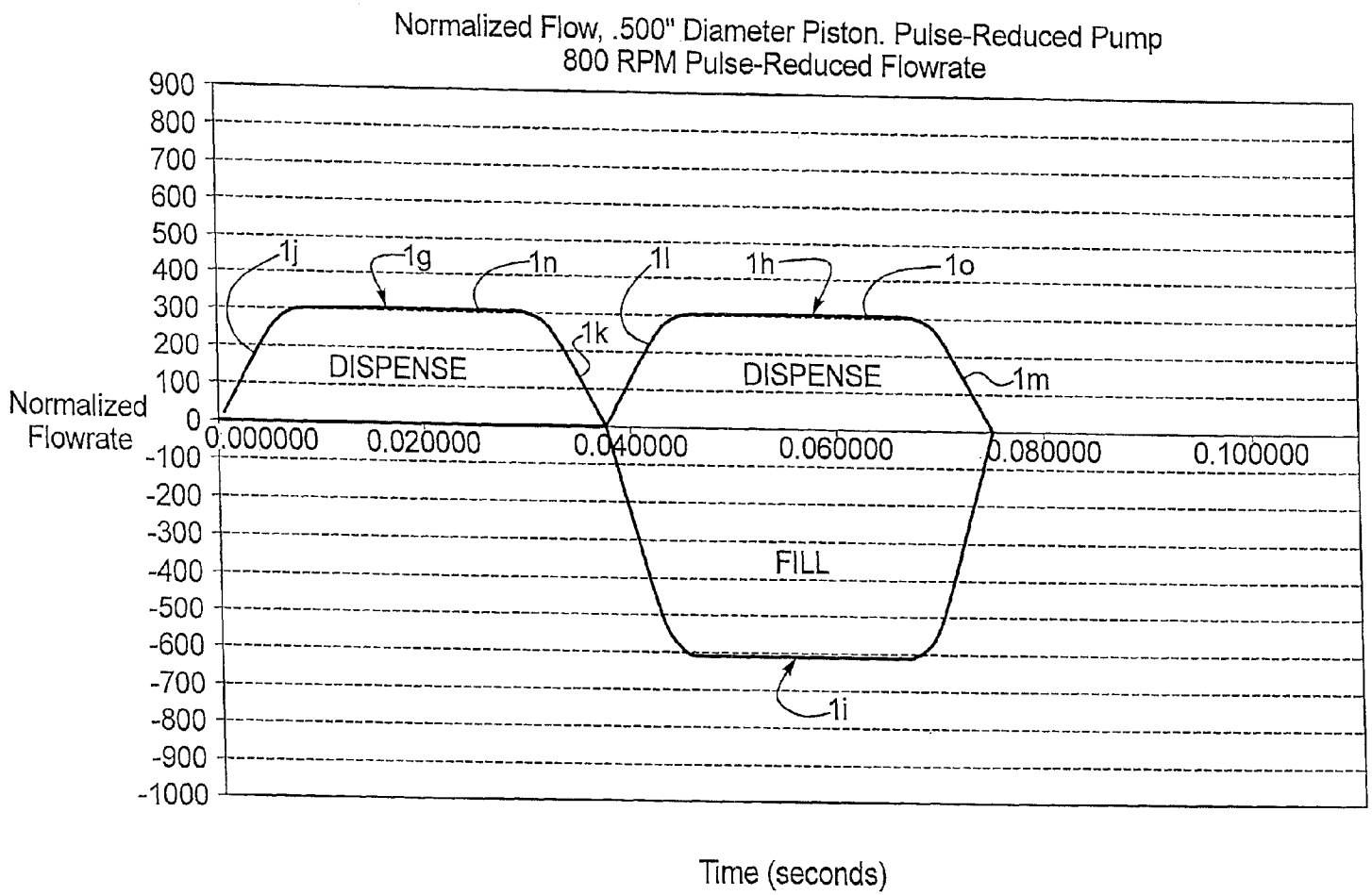
FIG. 5B graphically illustrates a dispense profile for a disclosed pump having an average motor speed of 800 rpm but with varying motor speeds to provide two modified dispense profiles, one of which occurs contemporaneously with the fill portion of the cycle.

Turning to FIG. 5B, two dispense portions of the cycle are shown at 1*g*, 1*h* and the fill portion of the cycle is shown at 1*i*. Like the scheme implemented in FIG. 2 above, the motor speed is varied to reduce the peak output flow rate by 25% from that shown in FIG. 5A by reducing the speed in the middle of the dispense cycles 1*g*, 1*h* and increasing the motor speed towards the beginning and end of each cycle 1*g*, 1*h*. The result is an increase in slope of the curves at the beginning and end of each cycles as shown at 1*j*-1*m* and a flattening of the dispense profiles as shown at 1*n*, 1*o*. This increase and decrease in the motor speed during the dispense cycle shown at 1*h* also results in an analogous flattened and widened profile for the fill cycle 1*i*.

Figure 5C:
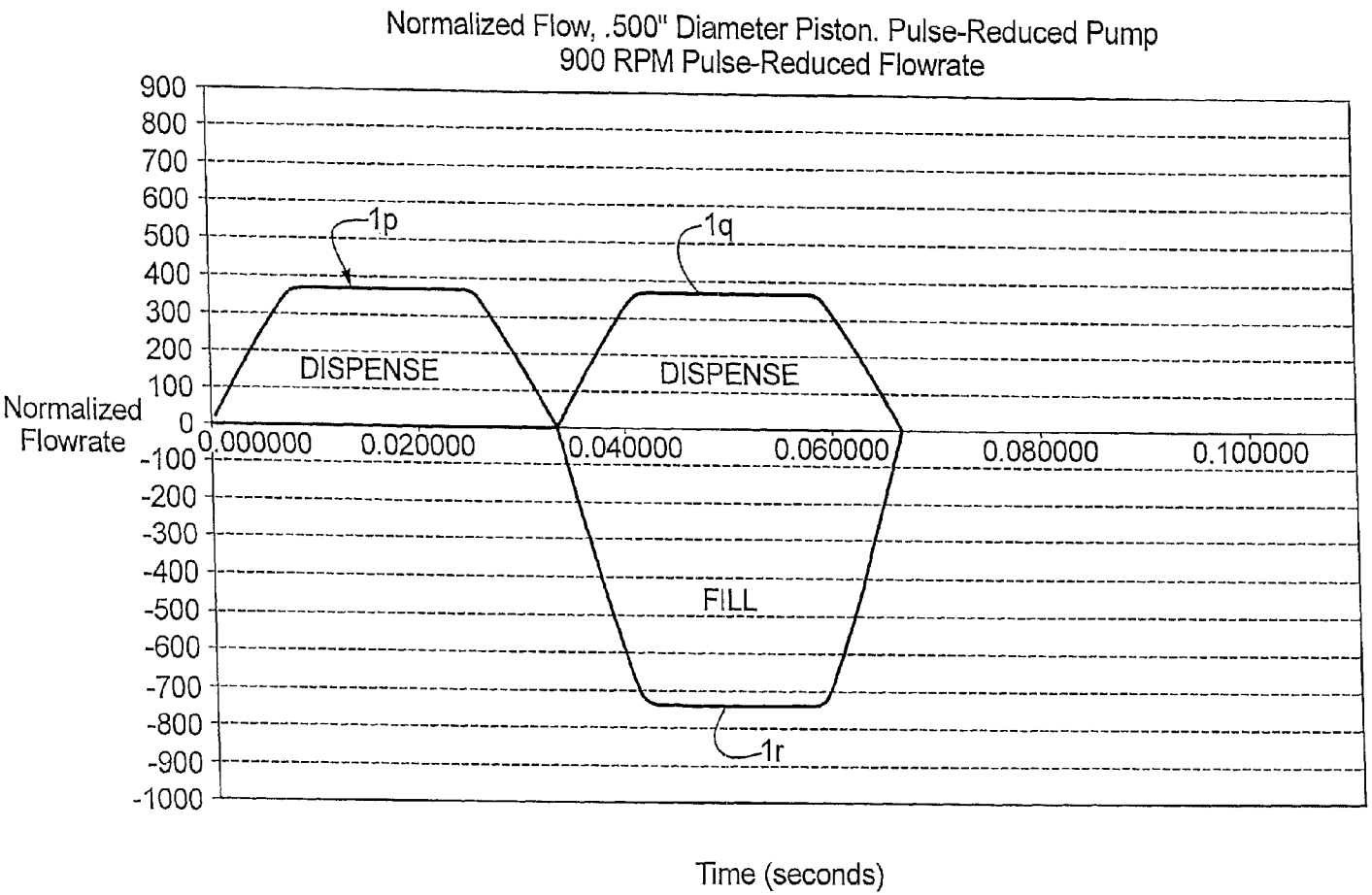
FIG. 5C graphically illustrates a dispense profile for a disclosed pump operating at an average motor speed at 900 rpm but with the motor speed varying to modify both dispense profiles, one of which occurs contemporaneously with the fill portion of the cycle.

Turning to FIG. 5C, similar dual dispense cycles 1*p* and 1*q* are shown along with a fill cycle 1*r*. However, in FIG. 5C, the average motor speed has been increased to 900 rpm while adopting the same pulse-reduction motor speed variations described for FIG. 5B. In short, the motor speed is increased at the beginning and end of each dispense cycle 1*p* and 1*q* and the motor speed during the flat portions of cycles 1*p*, 1*q* is reduced. The fill cycle 1*r* occurs simultaneously with the dispense cycle 1*q*. In terms of referring to the overall action of the piston 10*a*, the dispense cycle shown at 1*d*, 1*e*, 1*g*, 1*h*, 1*p* and 1*q* are, in fact, half-cycles of the complete piston movement illustrated in FIGS. 3A-3D.

Figure 7B:
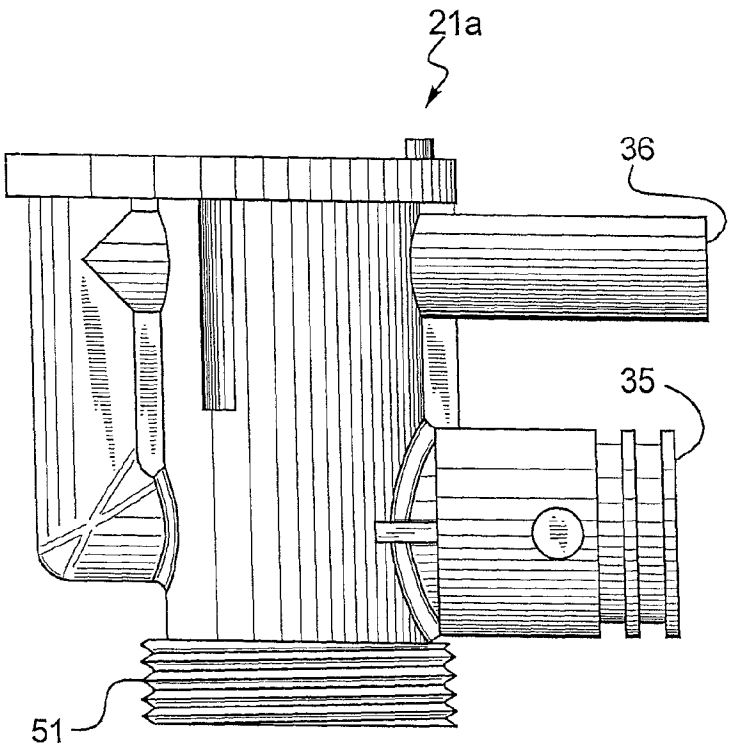
FIGS. 7A-7B are a perspective and plan view of a nutating pump housing or casing made in accordance with this disclosure.
Figure 7A:
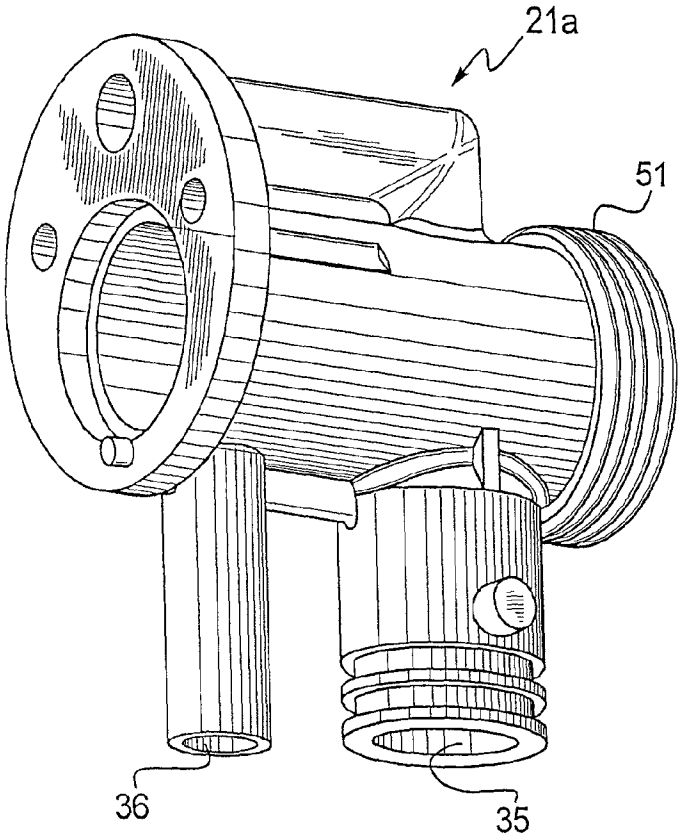

FIGS. 7A and 7B show an exemplary housing structure 21*a*. The head or end cap shown at 22 in FIGS. 3A-3C would be secured to the threaded fitting 51. The structure can be fabricated from molded plastic or metal, depending upon the application.

Figure 8A:
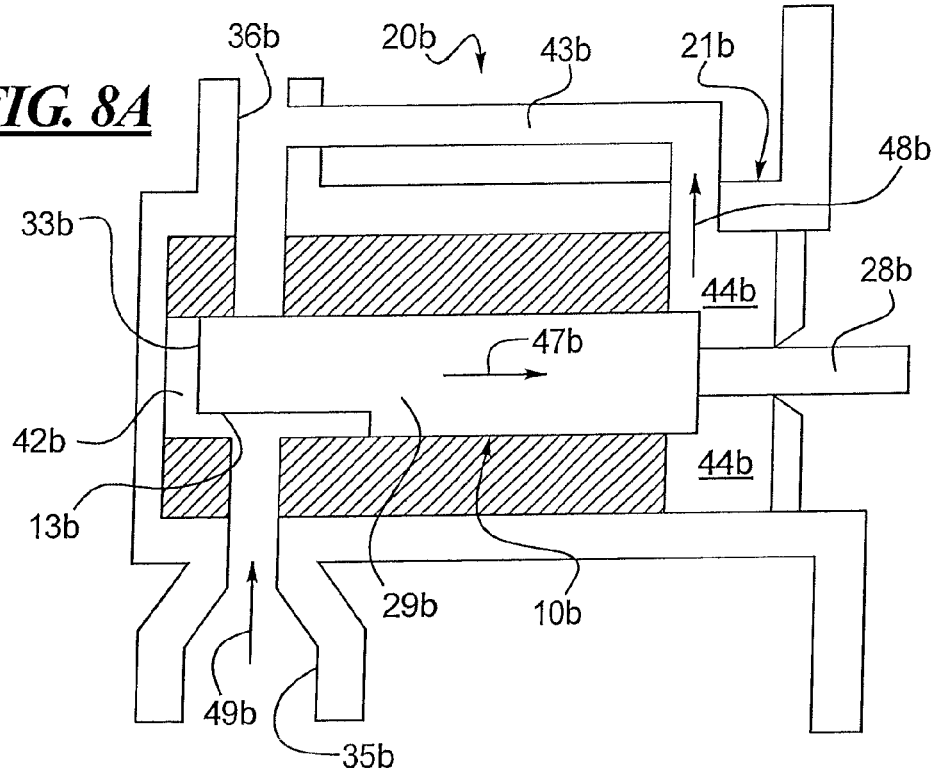
FIG. 8A is a sectional view illustrating another nutating pump made in accordance with this disclosure illustrating the piston in the middle of its downstroke.
Figure 8B:
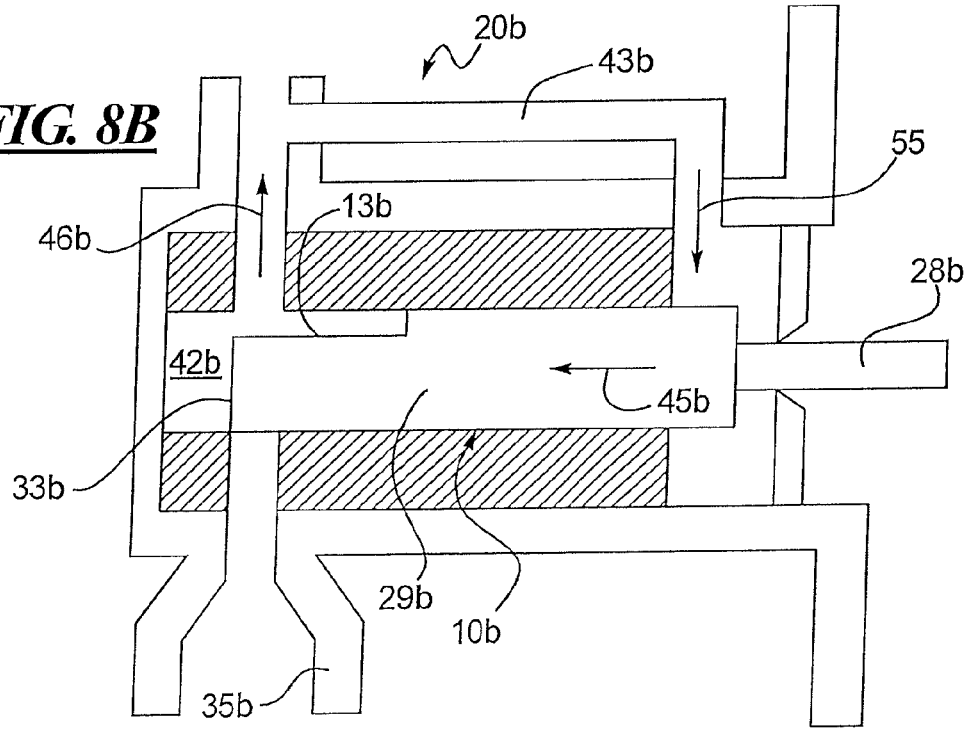
FIG. 8B is another sectional view of the pump shown in FIG. 8A illustrating the piston at the bottom of its downstroke.

Turning to FIGS. 8A-8B, an alternative pump 20*b* is shown. The pump 20*b* included a housing structure 21*b* and the passageway 43*b* extends outside of the housing 21*b*. The inlet 35*b* is in general alignment, or on the same size of the housing 21*b*, as the outlet 36*b*. The passageway 43*b* connects directly to the outlet 36*b*. The piston 10*b* includes a machined or flat section 13*b* and the pump section 29*b* includes a distal end 33*b*. The first chamber is shown at 42*b*. The proximal section 28*b* has a reduced diameter compared to that of the pump section 29*b*. Movement of the piston 10*b* in the direction of the arrow 47*b* results in displacement of fluid from the first chamber or area indicated at 44*b* and into the passageway 43*b*. Further, movement of the piston 10*b* in the direction of the arrow 47*b* as shown in FIG. 8A will also result in a loading of the first chamber 42*b* with fluid passing through the inlet 35*b* as indicated by the arrow 49*b*. Movement of fluid departing the second chamber 44*b* is indicated by the arrow 48*b*. Thus, the position of the piston 10*b* in FIG. 8A is analogous to the position shown for the piston 10*a* in FIG. 3D.

Turning to FIG. 8B, the piston is at or near the bottom of its stroke and the piston 10*b* is moving in the direction of the arrow 45*b* towards the first chamber 42*b*. As a result, fluid is pushed out of the first chamber 42*b* in the direction of the arrow 46*b*. Contemporaneously, the fluid is being loaded into the first chamber from the passageway 43*b* as shown by the arrow 55.

Figure 9A:
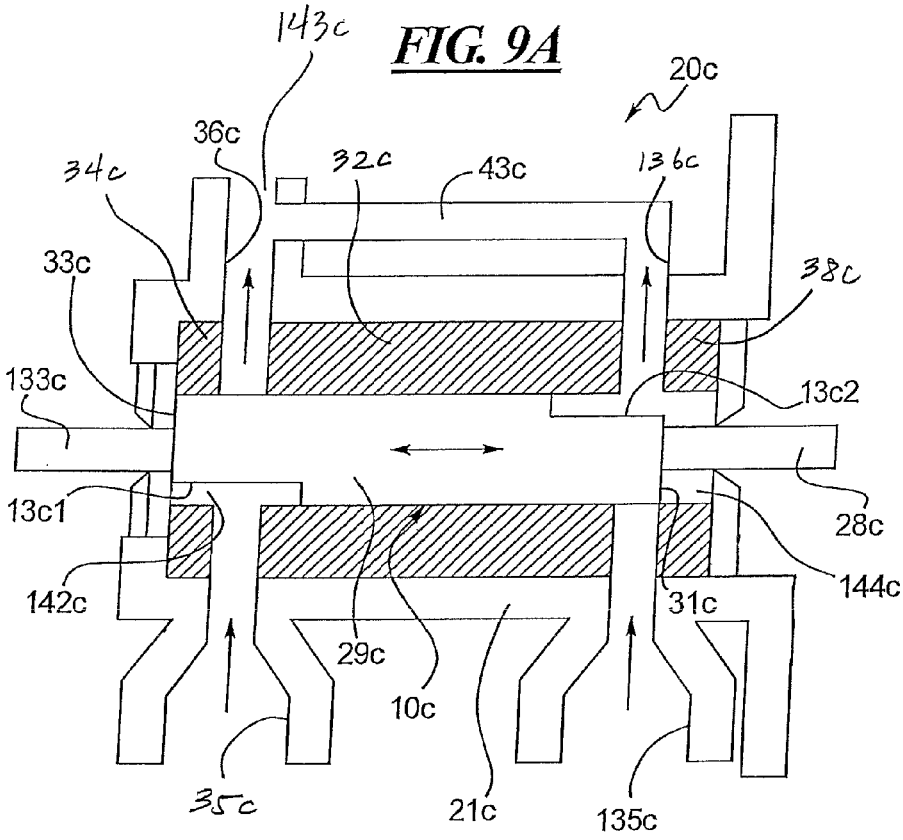
FIG. 9A is a sectional view of a dual chamber mixing and nutating pump with two flat or recessed sections on either end of the piston thereby providing for two pumping chambers, both of which have positive output and thereby requiring separate inlets for each pump chamber.
Figure 9B:
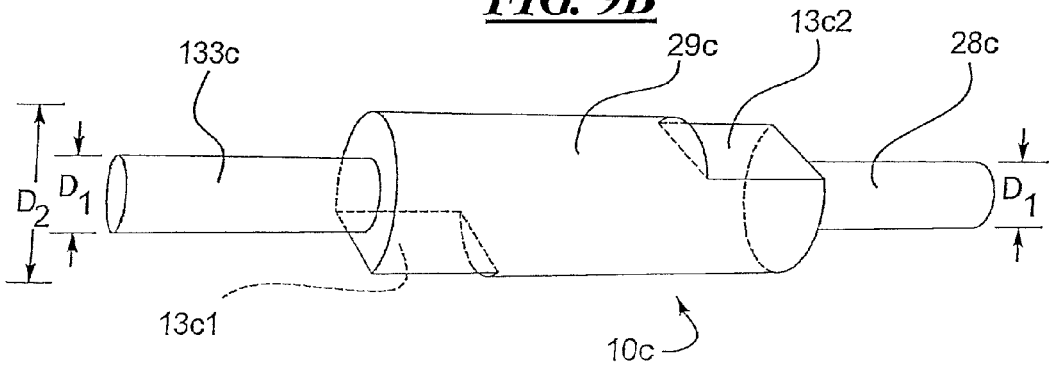
FIG. 9B is a perspective view of the piston shown in FIG. 9A.

Turning to FIGS. 9A-9B, a nutating piston 10*c* within a dual chamber nutating and mixing pump 20*c* is disclosed. The piston 10*c* features a distal recessed section 13*c*1 or flat as well as a proximal recessed section 13*c*2 or flat. Thus, the piston 10*c* includes a pump section 29*c* with two pumping elements, proximal and distal recessed sections 13*c*1, 13*c*2, based upon the axial rotation of the piston 10*c*. While the proximal section 28*c* includes a first maximum outer diameter, the pump section 29*c* includes a second maximum diameter, and the distal section 133*c* has a third maximum diameter. The second maximum diameter is greater than the first and third maximum diameters.

More specifically, the piston 10*c* includes two differences in maximum outer diameters including (a) a difference between the maximum outer diameters of the pump section 29*c* and proximal section 28*c*, as well as (b) a difference between the maximum outer diameters of the pump section 29*c* and distal section 133*c*. The difference (a) between the maximum outer diameters of the pump section 29*c* and proximal section 28*c* represents the annular area of the proximal end 31*c*. The difference (b) between the maximum outer diameters of the pump section 29*c* and distal section 133*c* represents the annular area of the distal end 33*c*. Using the annular areas of the proximal and distal ends 31*c*, 33*c*, lateral or reciprocating movement of the piston 10*c* also pumps fluid disposed in the two chambers 144*c*, 142*c*. In the embodiment 20*c* disclosed, the proximal and distal ends 31*c*, 33*c* present vertical walls in the embodiment disclosed. However, it should be noted that the vertical wall may also be slanted, rounded, beveled, or the like.

To provide more efficient pumping of fluids, the housing may further include a proximal seal 38*c*, a middle seal 32*c* and a distal seal 34*c*. Both the proximal chamber 144*c* and the distal chamber 142*c* produce a net output as they both include recessed sections 13*c*1, 13*c*2 as well as proximal and distal ends 31*c*, 33*c*.

Accordingly, the housing 21*c* includes two inlets, the proximal inlet 135*c* and the distal inlet 35*c*, as shown in FIG. 9A. The housing 21*c* also includes two outlets, the proximal outlet 136*c* and the distal outlet 36*c*, and the conduit or passageway 43*c* which connects between the outlets 136*c*, 36*c*. The passageway 43*c* then leads to a mixing chamber 143*c* where the two fluids may be mixed. Of course, a separate outlet for the proximal chamber 144*c* could be employed. Furthermore, passageways connecting the proximal and distal inlets 135*c*, 35*c* to their respective chambers 144*c*, 142*c* could be joined upstream of the chambers 144*c*, 142*c*.

Turning to the embodiment 10*c* of FIG. 9B, the distal section 133*c* has the same maximum outer diameter as the proximal section 28*c*, designated as $D_1$. The maximum outer diameter of the pump section 29*c*, or the second maximum diameter, is designated as $D_2$. The diameters may vary from diameters of the pistons 10 not made for mixing shown previously. This is because the dual chamber mixing pump 20*c* does not divide flow from a first chamber 42 over two portions of a complete dispense cycle or piston movement cycle as with the pumps 20 of FIGS. 3A-3D. Instead, each chamber

144*c*, 142*c* generates positive output independent of the other chamber 144*c*, 142*c*. Thus, both the proximal and distal chambers 144*c*, 142*c* are "first" pump chambers in the sense that this label is used for FIGS. 3A-3D. Therefore, a ratio of $D_1:D_2$ can vary and those skilled in the art will be able to find optimum values for their particular applications.

Figure 9C:
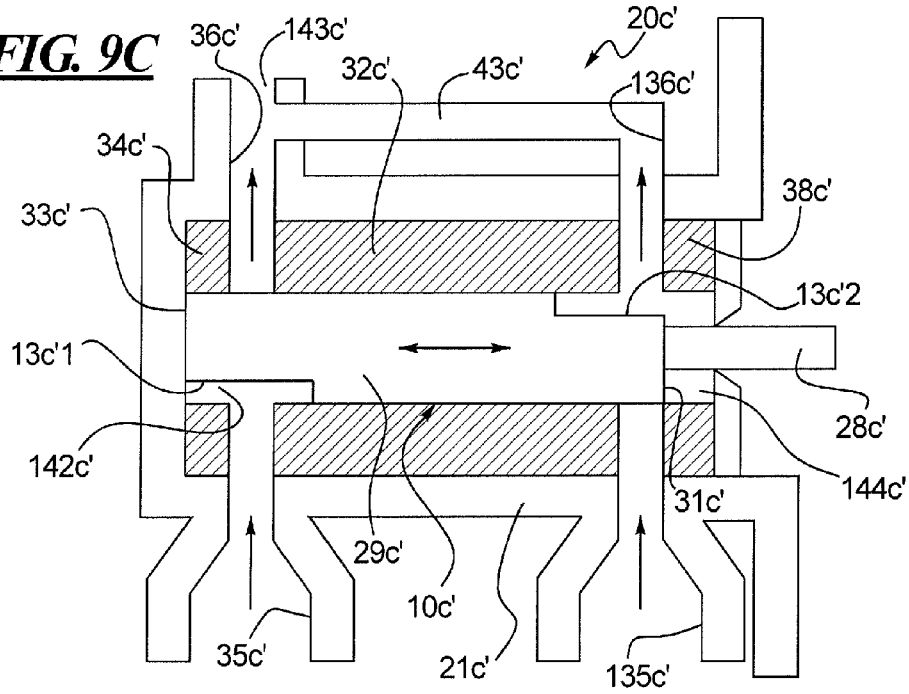
FIG. 9C is a sectional view of another dual chamber mixing and nutating pump having a piston without a distal section disposed on a distal end.

Turning to FIG. 9C, another dual chamber mixing pump 20*c*' is disclosed, which is similar to the pump 20*c* of FIG. 9A. Much like pump 20*c*, the dual chamber mixing pump 20*c*' comprises two mixing chambers 144*c*', 142*c*' and a piston 10*c*' with two recessed sections 13*c*'1, 13*c*'2. However, the piston 10*c*' does not have a distal section 133*c*. Accordingly, the housing 21*c*' does not provide a distal opening for the distal section 133*c* of the piston 10*c*' as in FIG. 9A. Instead, a closed end is formed on the housing 21*c*' that aids to define the distal chamber 142*c*' without a distal seal 34*c*'. Such an alteration results in a significant change in the displacement ratio between the two chambers 144*c*', 142*c*' because of the increase in the annular area of the distal end 33*c*'. The distal end 33*c*' of the piston 10*c*' pumps more fluid per revolution than the proximal end 31*c*' which still has the proximal section 28*c*'. Equal amounts of fluid cannot be pumped from both chambers 144*c*', 142*c*' in such a configuration.

Figure 10C:
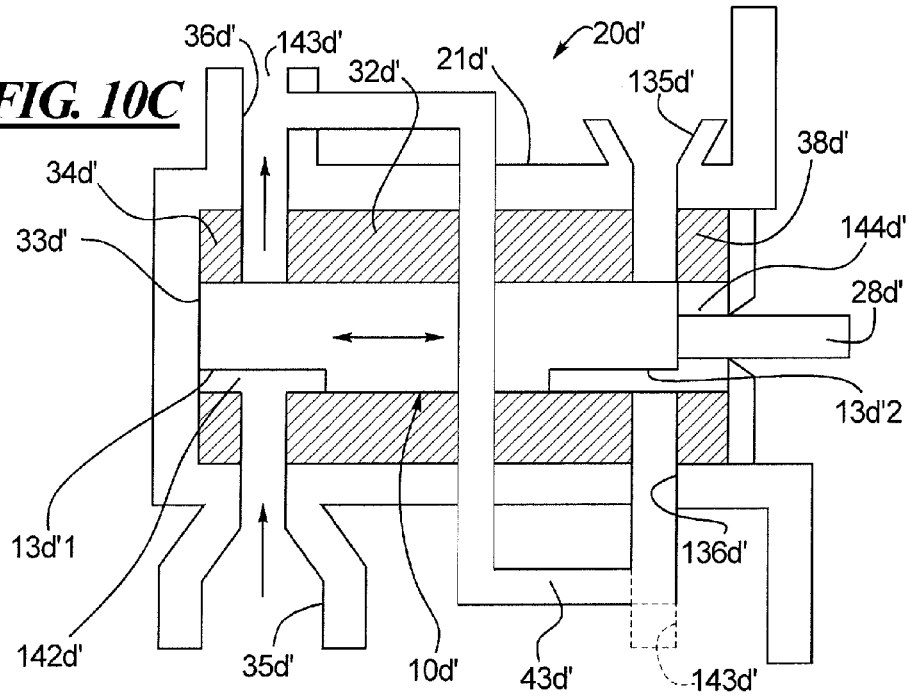
FIG. 10C is a sectional view of another dual chamber mixing and nutating pump having a piston without a distal section disposed on a distal end.
Figure 10A:
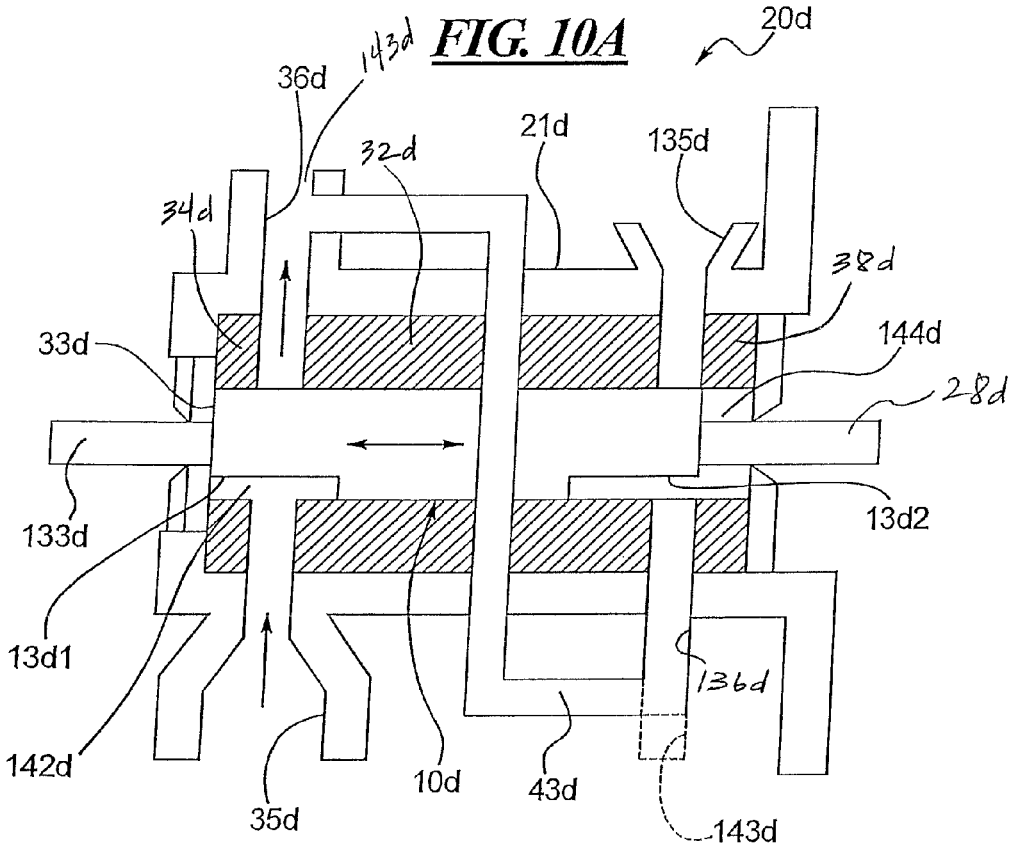
FIG. 10A is a sectional view of yet another dual chamber mixing pump made in accordance with this disclosure wherein the flat or recessed sections of the piston are disposed in alignment with each other thereby necessitating the design where the inlets are disposed on opposite sides of the housing from each other and the outlets also being disposed on opposite sides of the housing from one another.
Figure 10B:
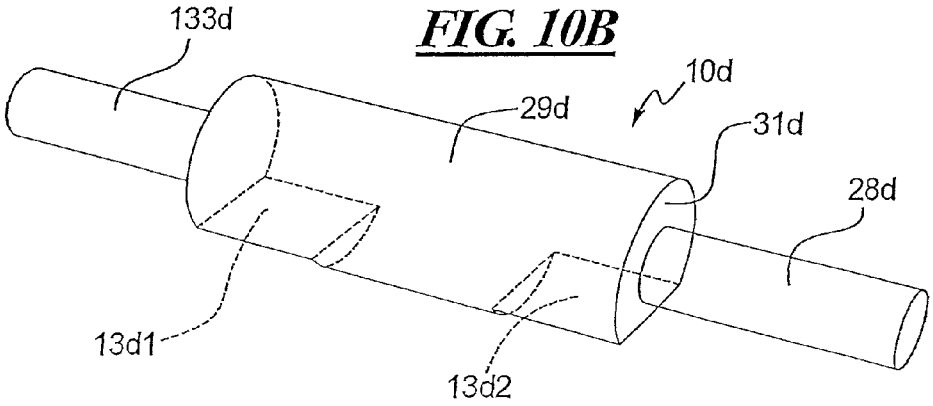
FIG. 10B is a perspective view the piston shown in FIG. 10A.

Turning to FIGS. 10A-10B, another dual chamber mixing pump 20*d* is disclosed, which is similar to the pump 20*c*. In the case of the pump 20*d*, the piston 10*d* includes two recessed sections 13*d*1, 13*d*2 disposed in alignment at either end of the pump section 29*d*. A distal section 133*d* extends outward from the distal end 33*d* of the pump section 29*d*. The proximal section 28*d* terminates at the proximal end 31*d* the pump section 29*d* which presents a vertical wall. The proximal end 31*d* of the piston 10*d* also presents a vertical wall. As with piston 10*c* previously disclosed, the vertical wall may also be slanted, rounded, beveled, or the like.

Because the recessed sections 13*d*1, 13*d*2 are in alignment along the pump section 29*d* of the piston 10*d*, the orientation of the proximal and distal inlets 135*d*, 35*d* must be moved to opposite sides of the housing 21*d* so as to distribute the outputs from the chambers 144*d*, 142*d* over the entire pump cycle of the piston 10*d*. That is, with the orientation of the recessed sections 13*d*1, 13*d*2 shown in FIGS. 10A-10B, if the inlets 135*d*, 35*d* were disposed on the same side of the housing 21*d* in a manner similar to the inlets 135*c*, 35*c* shown in FIG. 9A, all of the output would occur during a first half or portion of the piston cycle which could possibly cause splashing. By orientating the proximal and distal inlets 135*d*, 35*d* to opposite sides of the housing 21*d*, the output from one chamber 144*d*, 142*d* occurs in one half or one part of the cycle and the output from the other chamber 144*d*, 142*d* occurs in the other half or part of the cycle. Switching the inlets 135*c*, 35*c* to opposite sides of the housing 21*c* is not necessary for the pump 20*c* shown in FIGS. 9A-9B because the recessed sections 13*c*1, 13*c*2 are disposed on diametrically opposed portions of the pump section 29*c*. In the embodiment 20*d* shown in FIG. 10A, a passageway 43*d* is connected between the distal outlet 36*d* and the proximal outlet 136*d* leading to a mixing chamber 143*d*. This additional passageway 43*d* is not necessary as an additional outlet may be added externally.

As with FIG. 9C, a similar dual chamber mixing pump 20*d*' is disclosed in FIG. 10C. Fluids are pumped from two chambers 144*d*', 142*d*' using two recessed sections 13*d*'1, 13*d*'2 disposed on a piston 10*d*' that does not have a distal section. The only difference between pump 20*c*' and 20*d*' is the alignment of the recessed sections 13*d*'1, 13*d*'2 and the orientation of the inlets 35*d*', 135*d*' and outlets 36*d*', 136*d*'. Much like pump 10*c*', the annular area of the distal end 33*d*' without a distal section is significantly larger than that of the proximal end 31*d*'. Accordingly, the distal chamber 142*d*' pumps more fluid per revolution than the proximal chamber 144*d*' which is quite desirable for many industrial applications.

While the embodiments 20 shown in FIGS. 9A and 9C and 10A and 10C do not delay half or a substantial portion of the output of a chamber 144, 142 for a second half or a second portion of a dispense cycle, the pumps 20 do perform a pulse reduction function as the outlets 136, 36 disposed on either end of the pump sections 29 of the pistons 10 are delivered to the outlets 136, 36, or in essence the mixing chamber 143, during different parts of the piston movement cycle. Referring to FIGS. 9A and 9C, the output from the proximal chamber 144 is delivered during a different part of the cycle than the output from the distal chamber 142. Similarly, referring to FIGS. 10A and 10C, the output from the proximal chamber 144 is delivered during a different portion of the cycle than the output from the distal chamber 142. Therefore, pulse reduction is achieved. As in FIGS. 9A and 9C, a proximal seal 38, middle seal 32 and or a distal seal 34 may also be provided to further define the proximal and distal chambers 144, 142. Furthermore, the pumps 20 of FIGS. 9A, 9C, 10A and 10C can achieve further pulse reduction by modification of the motor speeds using algorithms like that shown in FIGS. 5B and 5C.

Figure 11A:
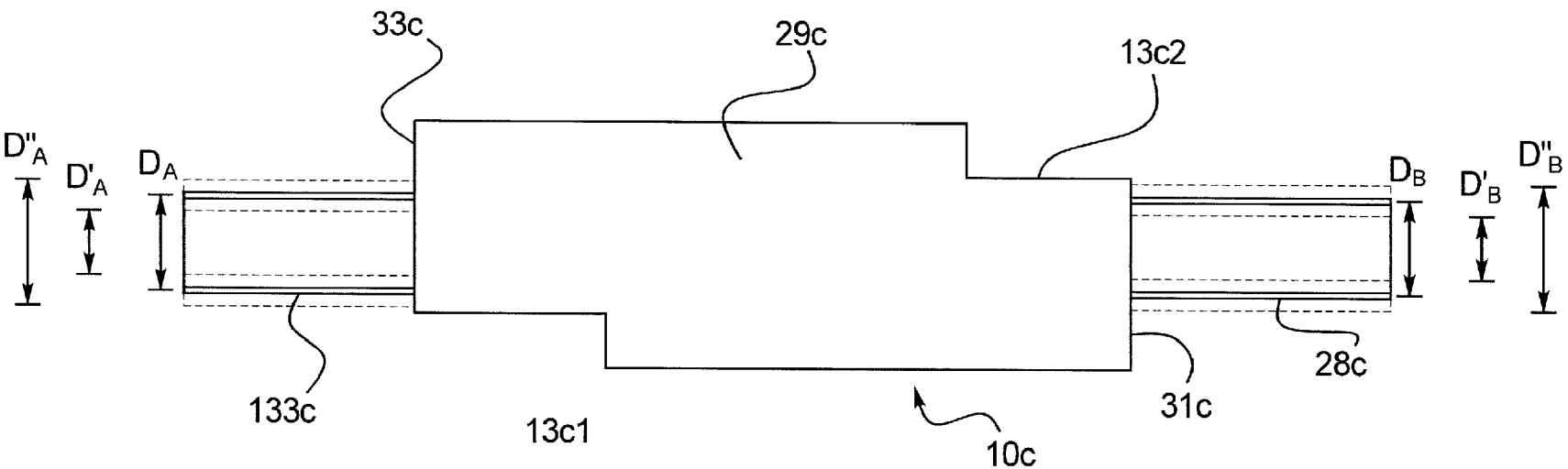
FIG. 11A is a cross-sectional view of the piston shown in FIGS. 9A-9B.

Turning to FIG. 11A, the piston 10*c* from FIGS. 9A-9B is shown. FIG. 11A shows, in phantom, exemplary ways to vary the annular areas of the proximal and distal ends 31*c*, 33*c*. Such changes to the dimensions of the piston vary the proportional output of the respective chambers 144*c*, 142*c*. Because the chambers 144*c*, 142*c* are defined in part by the proximal and distal ends 31*c*, 33*c*, varying their annular areas will alter the amount of fluid displacement. For example, in reducing the diameter $D_A$ of the distal section 133*c* to $D_A'$, the annular area of the distal end 33*c* increases and thus more fluid will be pumped per cycle from the distal chamber 142*c*. Increasing the diameter $D_A$ to the value $D_A''$ shown, decreases the annular area of the distal end 33*c* and thus less fluid will be pumped per cycle from the distal chamber 142*c*. Similarly, depending on adjustments made to the diameter $D_B$ of the proximal section 28*c*, the fluid pumped by the proximal chamber 144*c* will either increase or decrease.

Figure 11B:
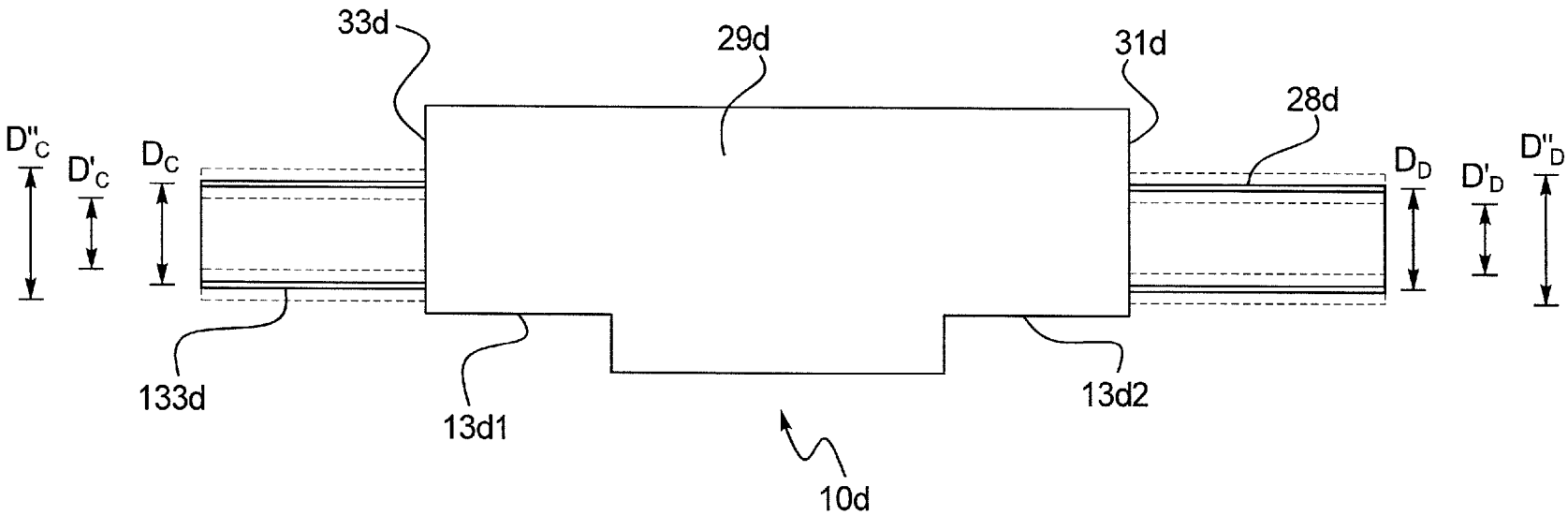
FIG. 11B is a cross-sectional view of the piston shown in FIGS. 10A-10B.

Finally turning to FIG. 11B, the piston 10*d* from FIGS. 10A-10B is shown. As with piston 10*c*, FIG. 11B shows in phantom, exemplary ways to vary the annular areas of the proximal and distal ends 31*d*, 33*d*. Much to the same as in FIG. 11A, the amount of fluid pumped per cycle by each chamber 144*d*, 142*d* is determined in part by the annular areas of the proximal and distal sections 28*d*, 133*d* and ends 31*d*, 33*d*. This is because the volumes of the chambers 144*d*, 142*d* are defined in part by the proximal and distal sections 28*d*, 133*d* and ends 31*d*, 33*d*. Increases in diameters $D_C$, $D_D$ of the proximal and distal sections 28*d*, 133*d* will decrease the respective annular areas. This results in reduced fluid output by the chambers 144*d*, 142*d*. Alternatively, decreases in diameters $D_C$, $D_D$ will increase the annular areas to produce more fluid output per cycle.

It should be noted that the adjustments described above may be applied to each side of the pistons 10*c*, 10*d* independently. For example, the diameter $D_A$ of the distal section 133*c* does not have to be the same as diameter $D_B$ of the proximal section 28*c*.

While only certain embodiments have been set forth, alternative embodiments and various modifications will be apparent from the above description to those skilled in the art. These and other alternatives are considered to fall within the spirit and scope of this disclosure.

What is claimed:

1. A dual chamber mixing pump, comprising:

a rotating and reciprocating piston disposed in a pump housing, the housing comprising a proximal inlet, a distal inlet, a proximal outlet and a distal outlet, the housing being connected to a proximal seal and a middle seal, the proximal and distal inlets and the proximal and distal outlets being integrally molded with the housing, the proximal and distal outlets being connected, the piston is unitary in structure and comprising a proximal section and a distal end with a pump section disposed between the proximal section and the distal end, the proximal section connected to the pump section at a transition section that extends between the proximal and pump sections, the proximal section is connected to a motor, the proximal section having a first maximum outer diameter, the pump section having a second maximum outer diameter that is greater than the first maximum outer diameter, the transition section having an inner diameter equal to about the first maximum outer diameter of the proximal section and an outer diameter equal to about the second maximum outer diameter of the pump section, the pump section of the piston comprising a proximal recessed section disposed between the transition section and the distal end and a distal recessed section disposed between the proximal recessed section and the distal end, a portion of the pump section of the piston disposed between the proximal and distal recessed sections is at least partially and frictionally received in the middle seal of the housing, the housing and piston defining two pump chambers including a proximal chamber defined by the proximal recessed section, the proximal end of the pump section and the proximal section of the piston and the housing, the proximal chamber in communication with the proximal inlet and the proximal outlet, and a distal chamber defined by the distal recessed section and the distal end of the pump section and the housing, the distal chamber in communication with the proximal inlet and the proximal outlet, the housing further comprising a passageway connected to the first pump chamber that extends around the middle seal and provides communication between the first and second pump chambers.

2. The pump of claim 1, wherein the proximal and distal recessed sections are in alignment with each other.

3. The housing of claim 2, wherein the proximal inlet and the distal outlet are disposed in alignment.

4. The housing of claim 2, wherein the proximal outlet and the distal inlet are disposed in alignment.

5. The pump of claim 1, wherein the proximal and distal recessed sections are disposed diametrically opposite the pump section of the piston from each other.

6. The pump of claim 1 further comprising a controller operatively connected to the motor, the controller generating a plurality of output signals including at least one signal to vary the speed of the motor.

7. The pump of claim 1, wherein the diameter of the proximal section is varied to adjust an area of the transition section of the piston, the varied area of the transition section, in turn, varying a proportional output of the proximal chamber.

8. The pump of claim 1, wherein the housing further comprises an external conduit that forms the passageway that provides communication between the proximal and distal outlets leading to a mixing chamber for mixing two fluids.

9. A dual chamber mixing pump, comprising:

a rotating and reciprocating piston disposed in a pump housing, the piston is unitary in structure, the housing comprising a unitary structure comprising a proximal inlet, a distal inlet, a proximal outlet and a distal outlet, each inlet and outlet pair are in fluid communication with an interior of the housing, the housing being connected to a proximal seal and a middle seal, the proximal and distal inlets and the proximal and distal outlets being integrally molded with the housing, the proximal and distal outlets being connected, the piston comprising a proximal section and a distal end with a pump section disposed between the proximal section and the distal end, the proximal section connected to the pump section at a transition section disposed between proximal section and the pump section, the proximal section is linked to a motor, the proximal section having a first maximum outer diameter, the pump section having a second maximum outer diameter that is greater than the first maximum outer diameter, the transition section having an inner diameter equal to about the first maximum outer diameter of the proximal section and an outer diameter equal to about the second maximum outer diameter of the pump section, the pump section of the piston comprising a proximal recessed section at the transition section and a distal recessed section at the distal end, the pump section extending between the proximal and distal ends, at least a portion of the pump section disposed between the proximal recessed section and the distal recessed section is at least partially and frictionally received in the middle seal, at least a portion of the pump section that comprises the proximal recessed section is frictionally received in the proximal seal, the proximal section of the piston passing through the proximal seal, the housing and piston defining two pump chambers including a proximal chamber defined by the proximal recessed section and the transition section, the proximal seal and the housing, and a distal chamber defined by the distal recessed section and the distal end of the piston and the housing, wherein the proximal and distal chambers are axially isolated from each other by the middle seal and the portion of the pump section of the piston disposed between the proximal recessed section and the distal recessed section.

10. The pump of claim 9, wherein a passageway connects between the proximal and distal outlets leading to a mixing chamber for mixing two fluids.

11. The pump of claim 9, wherein the proximal and distal recessed sections are in alignment with each other.

12. The pump of claim 9, wherein the proximal and distal recessed sections are disposed diametrically opposite the pump section of the piston from each other.

13. The pump of claim 9 further comprising a controller operatively connected to the motor, the controller generating a plurality of output signals including at least one signal to vary the speed of the motor.

14. The pump of claim 9, wherein the diameter of the proximal section is varied to adjust an area of the transition section, the varied area of the transition section, in turn, varying proportional output of the proximal chamber.

15. A method of mixing fluids, the method comprising:

providing a pump as recited in claim 1, connecting a supply of a first fluid to the proximal inlet, connecting a supply of a second fluid to the distal inlet, pumping first fluid from the proximal chamber to the proximal outlet and loading second fluid into the distal chamber by rotating and axially moving the piston so the proximal end of the pump section moves towards and into the proximal chamber and the distal end exits the distal chamber, and pumping second fluid from the distal chamber to the distal outlet and loading first fluid into the proximal chamber by rotating and axially moving the piston so the distal end of the pump section moves towards and into the distal chamber and the proximal end exits the proximal chamber.

16. The method of claim 15, wherein two pumps as recited in claim 1 are used out of phase from each other.

* * * * *